US006949148B2

(12) United States Patent
Sugiyama et al.

(10) Patent No.: US 6,949,148 B2
(45) Date of Patent: Sep. 27, 2005

(54) METHOD OF STRESS INDUCING TRANSFORMATION OF AUSTENITE STAINLESS STEEL AND METHOD OF PRODUCING COMPOSITE MAGNETIC MEMBERS

(75) Inventors: Satoshi Sugiyama, Toyohashi (JP); Syoichi Takenouchi, Toyota (JP); Takashi Ishikawa, Okazaki (JP)

(73) Assignee: DENSO Corporation, Kariya (JP)

( * ) Notice: Subject to any disclaimer, the term of this patent is extended or adjusted under 35 U.S.C. 154(b) by 197 days.

(21) Appl. No.: 10/310,342

(22) Filed: Dec. 5, 2002

(65) Prior Publication Data

US 2003/0121567 A1 Jul. 3, 2003

Related U.S. Application Data

(62) Division of application No. 09/496,959, filed on Feb. 3, 2000, now Pat. No. 6,521,055, which is a division of application No. 08/844,341, filed on Apr. 18, 1997, now Pat. No. 6,143,094.

(30) Foreign Application Priority Data

| | | |
|---|---|---|
| Apr. 26, 1996 | (JP) | 08-131428 |
| Sep. 30, 1996 | (JP) | 08-280064 |
| Jan. 14, 1997 | (JP) | 09-17445 |
| Jan. 21, 1997 | (JP) | 09-23292 |
| Feb. 13, 1997 | (JP) | 09-47247 |

(51) Int. Cl.[7] ..... H01F 1/00
(52) U.S. Cl. ..... 148/121
(58) Field of Search ..... 148/120–122

(56) References Cited

U.S. PATENT DOCUMENTS

| | | | | |
|---|---|---|---|---|
| 3,976,519 A | | 8/1976 | Kubo et al. | |
| 3,989,552 A | * | 11/1976 | Brook et al. | 148/563 |
| 4,007,073 A | | 2/1977 | Levin et al. | |
| 4,818,634 A | * | 4/1989 | Bliss | 428/677 |
| 5,821,000 A | | 10/1998 | Inui et al. | |
| 5,865,907 A | | 2/1999 | Katayama et al. | |

FOREIGN PATENT DOCUMENTS

| | | |
|---|---|---|
| EP | 0 629 711 | 12/1994 |
| JP | 63-161146 | 7/1988 |
| JP | 2-88715 | 3/1990 |
| JP | 4-259385 | 9/1992 |
| JP | 6-140216 | 5/1994 |
| JP | 8-3643 | 1/1996 |

OTHER PUBLICATIONS

The Proceedings of the 1996 Japanese Spring Conference for the Technology of Plasticity, pp. 4, 40–41.

* cited by examiner

*Primary Examiner*—John P. Sheehan
(74) *Attorney, Agent, or Firm*—Harness, Dickey & Pierce, PLC

(57) ABSTRACT

A method of stress inducing transformation from the austenite phase to the martensite phase by conducting cold working on material of austenite stainless steel in the temperature range from the point Ms to the point Md. The above cold working is a biaxial tensing. An intermediately formed hollow body is made, which includes a ferromagnetic portion and a non-magnetic portion contracting inward. Then, the intermediately formed body is subjected to a stress removing process in which residual tensile stress is removed from an intermediately formed body. In the stress removing process, it is preferable that a punch is press-fitted into the intermediately formed body so as to expand a non-magnetic portion and then the intermediately formed body is drawn with ironing while the punch is inserted so that the residual tensile stress can be changed into the residual compressive stress in the non-magnetic portion.

7 Claims, 22 Drawing Sheets

RELATED ART

RELATED ART

METHOD OF STRESS INDUCING TRANSFORMATION OF AUSTENITE STAINLESS STEEL AND METHOD OF PRODUCING COMPOSITE MAGNETIC MEMBERS

This application is a divisional of prior application Ser. No. 09/496,959, filed Feb. 3, 2000, now U.S. Pat. No. 6,521,055, which is a divisional of application Ser. No. 08/844,341, filed Apr. 18, 1997, now U.S. Pat. No. 6,143,094.

BACKGROUND OF THE INVENTION

1. Field of the Invention

The present invention relates to a method of stress inducing transformation of austenite stainless steel and methods of producing magnetic members and composite magnetic members.

2. Description of the Related Art

At present, austenite stainless steel is widely used in various fields of railway vehicles to kitchen utensils for domestic use. Therefore, great importance is attached to the mechanical property of austenite stainless steel. Concerning austenite stainless steel, the following are well known. When austenite stainless steel is subjected to cold working in a temperature range from the point Ms to the point Md, the martensite phase is generated from the austenite phase which is a mother phase, so that the stress induced-martensite transformation is caused. In this case, the point Ms is an upper limit temperature at which martensite is generated by the isothermal transformation, and the point Md is an upper limit temperature at which martensite is generated by the stress inducing transformation. In this case, the above austenite phase is an fcc phase (face centered cubic phase). On the other hand, almost all of the above stress induced-martensite phase is composed of an $\alpha'$ martensite phase of the bcc phase (body-centered cubic phase), and a very small amount of the $\epsilon'$ martensite phase of the hcp phase (hexagonal close-packed phase) is contained. The stress induced-martensite phase is defined as the aforementioned $\alpha'$ martensite phase in this specification, hereinafter.

In the case of a stress inducing martensite transformation, in accordance with increase in an amount of stress induced-martensite, there is a possibility that hardness and brittleness are increased and the mechanical property is changed.

However, as described above, the crystal structure of the austenite phase is different from that of the stress induced-martensite phase. Therefore, the austenite phase stainless steel is a non-magnetic member, and the stress induced-martensite phase stainless steel is a ferromagnetic member, that is, their magnetic properties are greatly different from each other.

Accordingly, when austenite stainless steel is used for a magnetic member or a composite magnetic member described later, it is very effective to increase a ratio of stress induced-ferromagnetic martensite phase.

On the other hand, according to the conventional producing method disclosed in Japanese Unexamined Patent Publication Nos. 7-11397 and 8-3643, it is impossible to increase the magnetic flux density $B_{4000}$ to a high magnetic level not less than 0.8 T (tesla), wherein the magnetic flux density $B_{4000}$ is defined as a magnetic flux density in the case of applying a magnetic field with an intensity of 4000 A/m.

The reason why it is impossible to increase the magnetic flux density $B_{4000}$ to a high magnetic level not less than 0.8 T (tesla) is considered as follows. An amount of strain which can be given to the magnetic member or the composite magnetic member is restricted by the limit at break and the shape of the member. According to the conventional cold working method, even if the maximum strain is given to the magnetic member or the composite magnetic member, a ratio of the generated stress induced-martensite is still low.

For the above reasons, there is a demand for developing a method of positively generating a large amount of stress induced-martensite, that is, there is a demand for developing a method of increasing an amount of the generation of stress induced-martensite with respect to an amount of the strain given to the magnetic member or the composite magnetic member.

Concerning the basic investigation with respect to the method of stress inducing transformation, for example, "Transformation Induced by Working of SUS304 in Various Stress Conditions" was reported in the Spring Lecture Meeting of Plastic Working held in 1995. However, even according to the above investigations, it was impossible to develop the method of generating stress induced-martensite at a high ratio.

In order to solve the above problems, it is a first object of the present invention to provide a method of stress inducing transformation by which stress induced-martensite can be generated in austenite stainless steel at a high ratio of generation, and to provide a method of producing a magnetic member or composite magnetic member, the ferromagnetic property of which is high.

Further, for example, in a device such as an electromagnetic valve having a magnetic circuit, it is necessary to provide parts in which ferromagnetic and non-magnetic portions are integrated with each other. In order to produce such parts having both ferromagnetic and non-magnetic portions, for example, ferromagnetic and non-magnetic parts are separately produced, and then they are integrally connected with each other. However, according to the above production method, the durability of the connecting portion of the ferromagnetic part with the non-magnetic part is not so high, and further the production cost increases.

On the other hand, Japanese Unexamined Patent Publication No. 8-3643 discloses a composite magnetic member and a production method thereof in which ferromagnetic and non-magnetic portions are contiguously formed without having a connecting portion.

As shown in an embodiment described later, the above composite magnetic member can be provided as follows. Austenite alloy steel of a specific composition is used. This austenite alloy steel is subjected to cold working in a predetermined condition so as to generate stress induced-martensite. In this way, the austenite alloy steel is made to be ferromagnetic. After that, desired portions are subjected to solution heat treatment, so that these portions can be made to be non-magnetic.

For example, as shown in FIGS. 22A to 22D, there is provided a composite magnetic member 6 in which the main body is composed of a ferromagnetic portion 2 and the opening side portion is composed of a non-magnetic portion 3. In order to produce the above composite magnetic member 6, first, as shown in FIGS. 15A to 15F explained later, a plate 101 of austenite alloy steel is subjected to pressing by a plurality of times. In this way, the austenite alloy steel plate 101 is formed into a U-shaped member 106 by cold working. Due to the above cold working, stress induced-martensite is generated in the entire U-shaped member 106. Therefore, the entire U-shaped member 106 becomes ferromagnetic.

Next, as shown in FIGS. 22A and 22B, the opening side portion of the U-shaped member 106 is subjected to solution annealing by a high frequency induction heating unit 98. Due to the above high frequency induction heating, the opening side portion of the U-shaped member 106 is made to be austenite, that is, a non-magnetic portion 3.

The thus obtained composite magnetic member 6 is excellent in the magnetic property. For example, the magnetic flux density $B_{4000}$ (the magnetic flux density at H=4000 A/m) of the ferromagnetic portion is not less than 0.3 T, and the specific permeability of the non-magnetic portion $\mu$ is lower than 1.2.

However, the following problems may be encountered in the above conventional composite magnetic member 6.

As shown in FIG. 23, stress corrosion cracks 99 tend to occur in the non-magnetic portion 3 close to the boundary between the non-magnetic portion 3 and the ferromagnetic portion 2.

The reason why stress corrosion cracks 99 tend to occur is considered as follows.

As described above, the conventional composite magnetic member 6 is composed of the ferromagnetic portion 2 made of martensite and the non-magnetic portion 3 made of austenite. The crystal structure of austenite and that of martensite are different from each other. Therefore, the density of austenite and that of martensite are different from each other. For the above reasons, the volume of martensite is larger than that of austenite by 3% when the weight of martensite is the same as that of austenite.

In the conventional composite magnetic member 6, material of austenite is used. This material of austenite is transformed into martensite so as to form the ferromagnetic portion 2. Then, a portion of the ferromagnetic portion 2 made of martensite is returned to austenite, so that the non-magnetic portion 3 can be formed. Therefore, as shown in FIGS. 22C and 22D, only the non-magnetic portion 3 is reduced in its volume by 3% compared with the volume of the ferromagnetic portion 2. As a result, residual tensile stress is generated in a portion of the non-magnetic portion 3 close to the boundary between the non-magnetic portion 3 and the ferromagnetic portion 2. It is considered that the generation of this residual tensile stress greatly deteriorates the stress corrosion cracking resistance property.

On the other hand, there is provided another method. As shown in FIGS. 24A to 24C, after the completion of high frequency induction heating for making a portion of the composite magnetic member 6 to be non-magnetic, a punch 96 is forced in the inside of the composite magnetic member 6 so as to expand the non-magnetic portion 3. In this way, the non-magnetic portion 3 is plastically deformed, so that the above residual tensile stress can be removed. However, according to the above method, the following problems may be encountered. As shown in FIGS. 25A to 25C, the size of expanding the non-magnetic portion 3 becomes too large (shown in FIG. 25A) or too small (shown in FIG. 25C), that is, it is difficult to completely control the intensity of residual stress. In order to form the non-magnetic portion 3 into the most appropriate shape as shown in FIG. 25B, it is necessary to control the outer diameter of the punch 96 at a high level of accuracy of 0.01 mm, which is very difficult.

Another conventional method of removing the residual stress is a method of annealing a portion at which the residual tensile stress has been generated. However, in order to completely remove the residual tensile stress generated in the portion close to the boundary between the non-magnetic portion 3 and the ferromagnetic portion 2, it is necessary to anneal the entire composite magnetic member. When the entire composite magnetic member is annealed, the ferromagnetic portion is changed into a non-magnetic portion. Since the performance of the ferromagnetic portion must be maintained in the composite magnetic member, it is impossible to apply the above method.

In view of the above conventional problems, the second object of the present invention is to provide a composite magnetic member and a production method thereof by which the performance of the ferromagnetic portion and the non-magnetic portion can be maintained and it is possible to ensure a high stress corrosion cracking resistance property, as well as to provide an electromagnetic valve made of the above composite magnetic member.

DESCRIPTION OF THE INVENTION

A first aspect of the present invention is to provide a method of stress induced-transformation of austenite stainless steel, comprising the step of conducting cold working on a material of austenite stainless steel in a temperature range not lower than the point Ms and not higher than the point Md so as to transform the austenite phase into the stress induced-martensite phase, wherein the cold working is a biaxial tensing.

The most remarkable point in the above embodiment is to conduct a biaxial tensing as the cold working. In this case, the biaxial tensing is defined as a work such as a bulging in which tensile stress is give to material in the biaxial directions which are different from each other, and the material is elongated in the direction of the tensile stress and is shrinked in the direction perpendicular to the direction of tensile stress.

Examples of the above biaxial tensing are: bulging described above (including various methods in which metallic dies, hydraulic pressure, rubber dies and rollers are used), expanding, electromagnetic forming (explosive forming), and incremental forming.

In this case, the number of conducting the biaxial tensing may be one or plural according to the object. Alternatively, different working methods may be combined, and working may be conducted by a plurality of times.

The above biaxial tensing is conducted in a temperature range not lower than the point Ms and not higher than the point Md. When the temperature is lower than the point Ms, there is caused a problem in which martensite is generated by isothermal transformation caused only by lowering the temperature without conducting any working. Therefore, it is impossible to generate stress induced-martensite at a high ratio. On the other hand, when the temperature is higher than Md, there is caused a problem in which a strain is simply given to the austenite phase and no stress induced-martensite is generated.

Next, the mode of operation of this embodiment will be explained as follows.

According to the method of stress inducing transformation of austenite stainless steel of this embodiment, a biaxial tensing is conducted as the cold working. Therefore, it is possible to remarkably enhance a ratio of the generation of stress induced-martensite compared with a uniaxial or biaxial compression working or a uniaxial tensing (shown in Example 1).

The reason why a ratio of the generation of martensite induced by working can be remarkably enhanced is considered as follows.

Since the phase of stress induced-martensite contains the bcc phase as described above, a volume per unit weight of stress induced-martensite is larger than that of the phase of austenite of the fcc phase. For this reason, the stress induced-martensite transformation is accompanied by an increase of volume.

On the other hand, various types of cold working cause the stress induced-transformation. The aforementioned biaxial tensing is a method of working by which the volume of material can be increased at the largest rate.

Therefore, in this embodiment, the biaxial tensing functions not only as a cold working to cause the stress induced-transformation but also as a working to facilitate an increase of volume caused when the austenite phase is transformed into the stress induced-martensite phase. Accordingly, in the present invention, it is possible to remarkably increase a ratio of the generation of stress induced-martensite compared with other types of cold working such as compression working.

Therefore, according to the present invention, it is possible to provide a method of stress inducing transformation by which stress induced-martensite can be generated at a high generation ratio in austenite stainless steel.

There is provided an explanation of the method of producing a magnetic member having a high ferromagnetic property, wherein the above method of stress inducing transformation of austenite stainless steel is used.

A second aspect of the present invention is to provide a method of producing a magnetic member, comprising the step of conducting cold working on a material of austenite stainless steel in a temperature range not lower than the point Ms and not higher than the point Md so as to stress inducing transform the non-magnetic austenite phase into the stress induced-ferromagnetic martensite phase, wherein the cold working is a biaxial tensing.

According to this aspect, it is possible to produce a magnetic member having a high ferromagnetic property by utilizing a physical property that the stress induced-martensite phase is a ferromagnetic body. From the physical viewpoint, the transformation from the austenite phase to the stress induced-martensite phase is the same as the transformation from the non-magnetic body to the ferromagnetic body. For the above reasons, this second aspect of the invention is substantially the same as the first aspect of the invention.

Therefore, according to this aspect, when the biaxial tensing is conducted as the above cold working, by the same effect of the first aspect, it is possible to generate stress induced-martensite at a high ratio of generation. Consequently, it is possible to easily obtain a magnetic member having a high magnetic property.

For the above reasons, when a composition of material and an amount of strain caused by the biaxial tensing are appropriately determined, it is possible to obtain a magnetic member having a very high ferromagnetic property, the magnetic flux density $B_{4000}$ of which reaches a value not lower than 0.8 T (shown in Example 3).

There is provided an explanation of the method of producing a composite magnetic member, wherein the above second aspect is used.

A third aspect of the present invention is to provide a method of producing a composite magnetic member, comprising the steps of: conducting cold working on a material of austenite stainless steel in a temperature range not lower than the point Ms and not higher than the point Md so as to transform the non-magnetic austenite phase into the stress induced-ferromagnetic martensite phase and form a ferromagnetic portion; and conducting a stress reducing treatment on a portion of said ferromagnetic portion so as to form a non-magnetic portion of the austenite phase, to thereby form a composite magnetic member comprising the ferromagnetic portion and the non-magnetic portion contiguous to each other, wherein the cold working is a biaxial tensing.

The most remarkable point of this invention is described below. When the biaxial tensing is conducted as described above, stress induced-martensite is generated so as to form a ferromagnetic portion. Then, a portion of the thus formed ferromagnetic portion is subjected to a solution heat treatment so as to form a non-magnetic portion.

By the above solution heat treatment, only a portion of the ferromagnetic portion to be changed into a non-magnetic portion is heated to a temperature not lower than the transformation temperature of austenite. Examples of the means for conducting the solution heat treatment are high frequency induction annealing and laser beam machining.

It is preferable that the solution heat treatment is conducted in a short period of time not longer than 10 seconds. Due to the foregoing, it is possible to maintain the crystal grain size of austenite to be not more than 30 $\mu$m, so that the specific magnetic permeability can be sufficiently reduced. On the other hand, when the solution heat treatment is conducted over a period of time exceeding 10 seconds, there is caused a problem in which the austenite structure becomes coarse.

In this case, the composite magnetic member is defined as a member in which the ferromagnetic portion and the non-magnetic portion are contiguous to each other in one body. In the above composite magnetic member, it is unnecessary to provide a connecting portion to connect the ferromagnetic portion with the non-magnetic portion. Accordingly, the thus composed composite magnetic member can be utilized as a very excellent member in the durability and the production cost to compose a magnetic circuit. For the above reasons, as described in the prior art, various producing methods of producing composite magnetic members are disclosed. The present invention aims to provide a method of producing a composite magnetic member having a ferromagnetic portion, the ferromagnetic property of which is higher than that of a composite magnetic member produced by the method of the prior art.

Next, the mode of operation of this embodiment will be explained below.

In the method of producing the composite magnetic member of this embodiment, the biaxial tensing is used as a means for forming the above ferromagnetic portion. As described above, a ratio of the generation of stress induced-martensite of this embodiment is remarkably higher than that of other methods. Therefore, it is possible to obtain a ferromagnetic portion, the ferromagnetic property of which is very high.

In the same manner as that of the embodiment according to the second aspect, when a composition of material and an amount of strain caused by the biaxial tensing are appropriately determined, it is possible for this ferromagnetic portion to have a very high ferromagnetic property, the magnetic flux density $B_{4000}$ of which reaches a value not lower than 0.8 T (shown in Example 3).

In this embodiment, as described above, a portion of the ferromagnetic portion is subjected to a solution heat treatment. Due to the foregoing solution heat treatment, the heat treated portion is easily returned to the austenite phase, that is, the heat treated ferromagnetic portion is changed into a non-magnetic portion.

For the above reasons, according to this embodiment, it is possible to produce a composite magnetic member in which a ferromagnetic portion, the ferromagnetic property of which is very high, and a non-magnetic portion are continuously formed in one member.

It is preferable that a uniaxial compression working or a biaxial compression working is conducted after the above biaxial tensing. In the above case, it is possible to increase a total amount of strain given to the above material, and further it is possible to provide a ferromagnetic portion, the ferromagnetic property of which is high. In general, when a total amount of strain is large in a cold working, an amount of the generation of stress induced-martensite is increased. Therefore, it is very effective that a compression working, by which a relatively large amount of strain can be provided, is further given to the material after the completion of a biaxial tensing by which only a relatively small amount of strain can be provided.

Examples of the above uniaxial compression working or the biaxial compression working are: spinning, swaging, drawing with a metallic die, rolling, cold forging, ironing, drawing, extruding, and bending with a metallic die.

In this case, the number of conducting the uniaxial compression working or the biaxial compression working may be one or plural according to the object. Alternatively, different working methods may be combined, and working may be conducted by a plurality of times.

It is preferable that the above cold working is conducted while it is divided into a plurality of stages. Due to the foregoing, it is possible to suppress a rise of temperature of the material when cold working is conducted. Therefore, it is possible to conduct a cold working in a temperature range not lower than the point Ms and not higher than the point Md.

The above cold working may be conducted while the material is forcibly cooled. Also, in this case, it is possible to conduct a cold working in a temperature range not lower than the point Ms and not higher than the point Md.

It is preferable that the above material is an austenite stainless steel, the composition of which is defined as follows. C is not more than 0.6 weight %, Cr is 12 to 19 weight %, Ni is 6 to 12 weight %, Mn is not more than 2 weight %, Mo is not more than 2 weight %, Nb is not more than 1 weight %, and the residual portion is composed of Fe and inevitable impurities, wherein Hirayama's Equivalent Heq=[Ni %]+1.05 [Mn %]+0.65 [Cr %]+0.35 [Si %]+12.6 [C %] is 20 to 23%, and the nickel equivalent Nieq=[Ni %]+30 [C %]+0.5 [Mn %] is 9 to 12%, and the chromium equivalent Creq=[Cr %]+[Mo %]+1.5 [Si %]+0.5 [Nb %]is 16 to 19%.

The reason why C is not more than 0.6% in the above composition of the material is described as follows. When the carbon content exceeds 0.6%, an amount of carbide is increased, and the working property is lowered. The reason why an amount of Cr is 12 to 19% and an amount of Ni is 6 to 12% is described as follows. When the amounts of these elements are decreased to values lower than the above lower limits, it is impossible to provide a sufficient non-magnetic property, the specific magnetic permeability $\mu$ of which is not higher than 1.2. On the other hand, when the amounts of these elements are increased to values higher than the above upper limits, it is impossible to provide a sufficient magnetic flux density $B_{4000}$ higher than 0.3 T. Further, when an amount of Mn exceeds 2%, the working performance is deteriorated.

Mo and Nb are not necessarily added, however, Mo is effective to lower the point Ms, and Nb is effective to enhance the mechanical strength of the material. Therefore, according to an object, Mo or Nb may be added alone or together. In this case, when Mo exceeds 2% and Nb exceeds 1%, the working property is deteriorated. Therefore, it is preferable that the upper limit of Mo is 2% and the upper limit of Nb is 1%.

As described above, when not only the composition of each element is restricted but also the elements are appropriately combined with each other, it is possible to surely provide a high magnetic property.

When Hirayama's Equivalent Heq is smaller than 20%, the specific magnetic permeability $\mu$ exceeds 1.2, and a sufficient non-magnetic property is not obtained. On the other hand, when Hirayama's Equivalent Heq exceeds 23%, it is difficult for the magnetic flux density $B_{4000}$ to exceeds 0.3 T.

For the same reason as that of Hirayama's Equivalent, the nickel equivalent Nieq is determined in a range from 9 to 12%, and the chromium equivalent Creq is determined in a range from 16 to 19%.

In this case, the material usually contains Si by an amount not more than 2% and Al by an amount not more than 0.5%, wherein Si and Al are contained as deoxidation elements, and also the material usually contains other impurity elements. However, there is no possibility that these elements deteriorate the property of the composite magnetic member.

Concerning the stainless steel produced in accordance with the first, second and third aspects described above, particularly the composite magnetic member, the shape may be formed into a cup shape, a cylindrical shape and a plate shape, etc., that is, it should be noted that the shape of the composite magnetic member is not particularly limited.

In order to accomplish the second object of the present invention, the present invention provides a method of producing a composite magnetic member comprising the steps of: forming an intermediately formed hollow body having a ferromagnetic portion and a non-magnetic portion, the non-magnetic portion contracting inward; and removing a residual tensile stress from the intermediately formed hollow body.

The most remarkable point of this embodiment is that the embodiment includes a stress removing process in which a residual tensile stress is removed from the intermediately formed body. Conventionally, the intermediately formed body is used as a composite magnetic member as it is. However, according to the present invention, the stress removing process is added to the producing process of the composite magnetic member.

It is possible to use various stress removing processes, however, it is necessary that at least the residual tensile stress is relieved or removed. A compressive stress may be remained as a result of conducting the stress removing process. As a specific stress removing process, it is preferable to adopt a process in which a mechanical stress is given from the outside, the detail of which will be described later. Due to the foregoing, it is possible to remove a residual tensile stress without deteriorating the magnetic property of the above composite magnetic member.

Next, the mode of operation of this embodiment will be explained as follows.

According to the method of producing the composite magnetic member of the embodiment of the present invention, the aforementioned intermediately formed body is subjected to the above stress removing process. In this stress removing process, the residual tensile stress is sufficiently relieved or removed from the intermediately formed body. Therefore, the occurrence of stress corrosion cracks caused by a residual tensile stress can be surely prevented.

Consequently, according to this embodiment, it is possible to provide a method of producing a composite magnetic member having a high anti-stress corrosion property while the magnetic performance of the ferromagnetic portion and that of the non-magnetic portion are maintained.

Concerning the hollow shape of the intermediately formed body, it is sufficient that the intermediately formed body has a hollow portion inside. Examples of the shape of the intermediately formed body are a cylindrical shape having no bottom; and other shapes having bottom portions.

It is preferable that the cross-section of the intermediately formed hollow body is a U-shape. This shape is advantageous in that the intermediately formed hollow body can be easily subjected to clod drawing.

The following embodiment is a specific means for removing stress.

It is preferable to produce a composite magnetic member as follows. In the stress removing process, a punch is forced or press-fitted into the above intermediately formed body so that the non-magnetic portion is expanded. After that, under the condition that the punch is inserted, the intermediately formed body is subjected to drawing with ironing so that the residual tensile stress can be changed into a residual compressive stress in the non-magnetic portion.

The most remarkable point of this embodiment is that the punch is forced into the intermediately formed body and then the intermediately formed body subjected to drawing with ironing as described above.

As described later, the intermediately formed body is provided in such a manner that after austenite alloy steel has been subjected to cold drawing so that it can be formed into a hollow shape, a portion of the hollow shape is subjected to high frequency induction heating. In other words, the non-magnetic portion can be formed as follows. Stress-induced martensite is generated by conducting cold working on the intermediately formed body, so that the intermediately formed body is made to be ferromagnetic. After that, a portion of the intermediately formed body is subjected to solution annealing, so that the portion can be returned from martensite to austenite. In this way, the non-magnetic portion can be formed.

In the intermediately formed body that has been made in the above manner, the non-magnetic portion is contracted inward as described above, and a residual tensile stress is generated in a portion close to the boundary between the non-magnetic portion and the ferromagnetic portion.

When the outer diameter of the intermediately formed body is determined, it is necessary to give consideration to an amount of reduction of the thickness caused in the process of ironing.

The punch used for expanding the non-magnetic portion and also used for conducting ironing is composed as follows. The outside diameter of the punch is the same as or slightly larger than the inside diameter of the main body of the intermediately formed body. Accordingly, when the punch is inserted into the intermediately formed body, it is closely contacted with the inner wall of the intermediately formed body.

When the above ironing is conducted, an ironing ratio is determined so that a residual tensile stress can be changed into a residual compressive stress in the intermediately formed body. However, when an ironing ratio is increased, that is, when a ratio of working is increased, the specific magnetic permeability $\mu$ of the non-magnetic portion increases, and its property is deteriorated. For the above reasons, it is necessary to give consideration so that the ratio of working is not increased too high.

Next, the mode of operation of this embodiment will be explained as follows.

According to the method of producing the composite magnetic member of this embodiment, after the intermediately formed body has been made, the punch is forced or press-fitted into it. Due to the foregoing, the non-magnetic portion is expanded and closely contacted with the outer circumference of the punch. At the same time, the ferromagnetic portion is also closely contacted with the outer circumference of the punch. Therefore, even if the inner diameters of the ferromagnetic portion and the non-magnetic portion fluctuate a little, the inner diameter of the thus obtained composite magnetic member can be made to be the same.

Next, while the punch is inserted into the intermediately formed body, it is subjected to ironing. Due to the above ironing, the thickness of the ferromagnetic portion can be made to be the same as the thickness of the non-magnetic portion. Therefore, the outer diameter of the ferromagnetic portion can be made to be the same as the outer diameter of the non-magnetic portion. When the above drawing with ironing is conducted, a ratio of drawing with ironing is determined so that a residual tensile stress can be changed into a residual compressive stress in the intermediately formed body and the property of the non-magnetic portion can not be deteriorated.

Therefore, a residual tensile stress can be changed into a residual compressive stress in the composite magnetic member while the magnetic properties of the non-magnetic portion and the ferromagnetic portion are maintained in the intermediately formed body.

For the above reasons, the stress corrosion-resistance property of the composite magnetic member can be sufficiently enhanced.

It is preferable that an ironing ratio is maintained at 2 to 9% in the process of ironing. Due to the foregoing, while the properties of the non-magnetic portion and the ferromagnetic portion are positively maintained in the intermediately formed body, a residual tensile stress can be changed into a residual compressive stress in the non-magnetic portion.

When the ratio of ironing is lower than 2%, there is a possibility that the residual tensile stress is not changed into the residual compressive stress. When the ratio of ironing exceeds 9%, there is a possibility that the specific magnetic permeability $\mu$ of the non-magnetic portion increases and its property is deteriorated. In this connection, the ratio of ironing is expressed by $(t_0-t)/t_0\times100$, wherein the thickness of material before conducting the ironing is $t_0$, and the thickness of material after the completion of working is t.

The following embodiment is another specific means for removing residual stress.

In this process for removing residual stress, shot peening may be conducted on the inside or the outside of the above intermediately formed body where residual tensile stress has been generated. In this shot peening process, shot particles are made to collide with the inside or the outside of the above intermediately formed body.

In this case, the residual tensile stress can be greatly reduced or removed by the very simple process of shot peening. Therefore, it is possible to greatly enhance the anti-stress corrosion property while the production cost is maintained low.

According to the above method, shot particles are made to collide with a portion where tensile stress is given. Therefore, it is possible to reduce an intensity of residual tensile stress irrespective of the shape of the intermediately formed body.

When the above intermediately formed body having the ferromagnetic portion and the non-magnetic portion is produced, it is preferable that only a desired portion is heated so that the portion can be made to be non-magnetic after the material of the intermediately formed body has been subjected to cold drawing and made to be ferromagnetic. By the above method, it is possible to easily produce the above intermediately formed body, the magnetic property of which is high.

Another embodiment of the composite magnetic member produced by the above method is described as follows.

Another embodiment is a composite magnetic hollow member having a ferromagnetic portion and a non-magnetic portion wherein the composite magnetic hollow member is produced by one of the method described above.

Since this composite magnetic member is produced by the production process in which residual stress is removed, its stress corrosion cracking resistance property is very high as described above.

The cross-section of the hollow shape of the above composite magnetic member may be made to be a U-shape. In this case, it is preferable to compose this composite magnetic member in such a manner that the bottom side is formed into a ferromagnetic portion and the opening end side is formed into a non-magnetic portion. Due to the foregoing, the bottom side can be easily made to be ferromagnetic and the opening end side can be easily made to be non-magnetic.

The following is an embodiment of the invention which is an electromagnetic valve in which the above composite magnetic member, the magnetic property of which is high, is used.

The present invention provides an electromagnetic valve comprising: a coil for forming a magnetic circuit; a sleeve arranged in the magnetic circuit formed by the excitation of the coil; a plunger slidably arranged in the sleeve; and a stator arranged being opposed to the plunger via a moving space, wherein a fluid passage is opened and closed when the plunger is moved toward the stator by the excitation of the above coil, the sleeve is made of the composite magnetic member described above, and a non-magnetic portion of the composite magnetic member is arranged so that the non-magnetic portion surrounds a moving space formed between the plunger and the stator.

The electromagnetic valve is one of the mechanical parts used for opening and closing a fluid passage of an automobile or other machines. Accordingly, there is a demand for high durability. In view of satisfying the demand for high durability, it is appropriate to use the composite magnetic member produced by the above method when the sleeve of the electromagnetic valve is made. That is, the thus made sleeve has a high anti-stress corrosion cracking property while it maintains a high magnetic property. For the above reasons, the durability of the entire electromagnetic valve into which this sleeve is incorporated can be greatly enhanced.

A method of producing a steel member comprising a non-magnetic portion and a magnetic portion, comprising the steps of a first step of cold rolling non-magnetic austenite steel to continuously form a ferromagnetic martensite elongated body; a second step of selectively annealing a predetermined portion of the elongated body corresponding to a non-magnetic portion to be formed; and a third step of forming said partially annealed elongated body into a shape and separating a steel member having a predetermined shape from said shaped elongated body.

When steel is subjected to cold rolling in the first step, stress inducing transformation of martensite occurs, so that the steel is made to be a structure of martensite. An elongated body is made of this ferromagnetic member. When annealing is partially conducted in the successive second step, a portion of the structure of martensite is returned to the structure of austenite, so that a non-magnetic portion is partially generated. In the third step, a member of steel, the shape of which is predetermined, can be completed by means of punching or cutting.

The remarkable point of this embodiment is described as follows. Predetermined portions of a ferromagnetic elongated body are successively annealed so that they can be changed into non-magnetic portions. After the formation of the non-magnetic portions, the members of steel, the shapes of which are predetermined, are successively separated.

In this embodiment, the elongated body is subjected to the first, the second and the third steps. Accordingly, the composite magnetic member can be easily mass-produced, and the productivity is high. Since annealing is conducted before forming (the third process), it is possible to form a non-magnetic member with high accuracy. Therefore, even small parts can be easily produced. Accordingly, even small members made of composite magnetic substance can be effectively mass-produced.

When the second step of annealing is conducted by irradiating laser beams, it is possible to form precise non-magnetic portions. In other words, when laser beams are utilized, it is possible to conduct a precise local annealing.

When the second step of annealing is conducted by high frequency induction heating, a thick plate can be subjected to a precise local annealing.

In the third step, it is preferable to adopt a separation method in which warm punching is conducted at a temperature in the range from 40° C. to 600° C.

When members are separated by means of punching, a minute amount of martensite (ferromagnetic portion) is generated in a small region of separation in which stress is acting. The thus generated ferromagnetic portion seldom affects the performance of a product, however, in the case of a small product, its performance is deteriorated. However, when warm punching is conducted at a temperature not lower than 40° C., the generation of martensite can be suppressed, and it is possible to produce a highly accurate product. However, when the temperature exceeds 600° C., the entire member becomes non-magnetic, and it is impossible to produce a member of steel composed of a non-magnetic portion and a ferromagnetic portion. For this reason, it is preferable to maintain the punching temperature in the range from 40° C. to 600° C.

EXAMPLES

Example 1

Referring to FIGS. 1, 2 and 3A to 3D, there is explained a method of stress inducing transformation of austenite stainless steel of an example of the present invention.

According to the method of stress inducing transformation of austenite stainless steel of this example, material made of austenite stainless steel is subjected to cold working in a temperature range not lower than the point Ms and not higher than the point Md, so that the austenite phase can be transformed into the stress induced-martensite phase. In this example, cold working is a biaxial tensing.

In order to confirm the effect of the present invention, two types of materials were prepared. Thus prepared materials were subjected to cold working in various ways, and amounts of the generated stress induced-martensite were measured so as to make investigation into the effect of cold working.

Figure 3A:
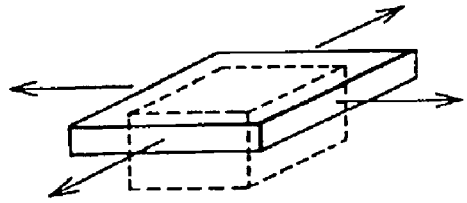
FIG. 3A is a schematic illustration showing a model of the biaxial tension in Example 1.
Figure 3B:
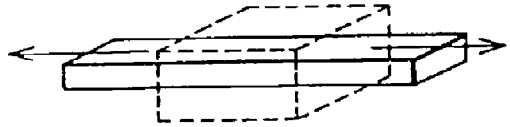
FIG. 3B is a schematic illustration showing a model of the uniaxial tension in Example 1.
Figure 3C:
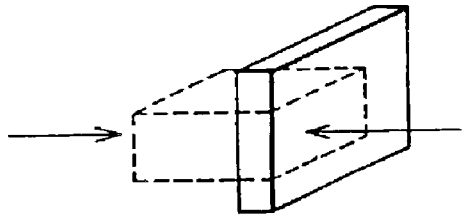
FIG. 3C is a schematic illustration showing a model of the uniaxial compression in Example 1.
Figure 3D:
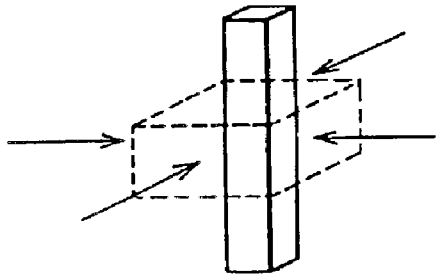
FIG. 3D is a schematic illustration showing a model of the biaxial compression in Example 1.

Concerning the method of cold working, as the models are shown in FIGS. 3A to 3D, four types of methods were investigated including a biaxial tensing (shown in FIG. 3A), uniaxial tensing (shown in FIG. 3B), uniaxial compression (shown in FIG. 3C), and biaxial compression (shown in FIG. 3D).

In this connection, two types of materials of SUS301 and SUS304 were prepared. The respective chemical compositions are shown on Table 1.

Test pieces of SUS301 were made of a sheet, the thickness of which was 1 mm, and test pieces of SUS304 were made of an ingot. In this connection, the test pieces of SUS301 were made as follows. Two sheets of SUS301 were put upon each other and joined by the thermal diffusion method. Then the joined sheets were machined into a block member and subjected to finishing heat treatment. In this way, test pieces for uniaxial compression and those for biaxial compression were made.

Each test piece, the shape of which was machined into a predetermined shape, was subjected to solution heat treatment while it was kept for the time of 7.2 ks under the condition that the degree of vacuum was $10^{-3}$ Pa and the temperature was 1373K. However, concerning the test pieces for uniaxial and biaxial compressions, for the reasons of joining and finishing, the solution heat treatment was conducted when the test pieces were held for the total time of 5.8 ks in total.

As a result, with respect to all test pieces, the crystal structure was adjusted to the crystal grain size number 6. It was possible to provide test pieces in which it was unnecessary to give consideration to the difference of grain sizes.

TABLE 1

| | C | Si | Mn | P | S | Cr | Ni | Fe |
|---|---|---|---|---|---|---|---|---|
| SUS 301 | 0.11 | 0.64 | 0.71 | 0.029 | 0.002 | 17.01 | 6.81 | Bal. |
| SUS 304 | 0.026 | | | | | 17.76 | 8.28 | Bal. |

Next, a method of test for conducting each cold working will be explained below.

In the uniaxial tensile test, the thirteenth test piece stipulated by JIS Z2201 was used. The size of the test piece is described as follows. Width W is 10 mm, measuring points distance L is 40 mm, length of the parallel portion P is 60 mm, radius R of curvature of the shoulder portion is 10 mm, and thickness T is 1 mm. The test was made by the Instron Universal Tester. In the test, an equivalent strain $\epsilon$=0.445 was given to the test piece of SUS301, and an equivalent strain $\epsilon$=0.281 was given to the test piece of SUS304.

In the uniaxial compression test, a cubic test piece, the length of one side of which was 15 mm, was used as a compression test piece. Using a hydraulic type compression tester, the compression test piece of SUS301 was given an equivalent strain $\epsilon$=1.000 at the maximum, and the compression test piece of SUS304 was given an equivalent strain $\epsilon$=0.910 at the maximum while lubrication was repeatedly conducted.

In the biaxial tensing test, a disk-shaped bulging test piece was used, wherein the diameter of the test piece was 90 mm and the thickness of the test piece was 1 mm. Using a deep drawing tester, the test piece was subjected to a bulging test. The test piece of SUS301 was given an equivalent strain $\epsilon$=0.204 at the maximum, and the test piece of SUS304 was given an equivalent strain $\epsilon$=0.163 at the maximum. N this way, the equal biaxial tensing test was made.

In the biaxial compression test, the same cubic test piece as that of the uniaxial compression test, the length of one side of which was 15 mm, was used. This equal biaxial compression test was made by a biaxial compression tester in which a hydraulic compression tester and a device to give a horizontal load by a stepping motor were combined with each other. In this equal biaxial compression test, the test piece of SUS301 was given an equivalent strain $\epsilon$=0.157, and the test piece of SUS304 was given an equivalent strain $\epsilon$=0.176.

All the tests described above were carried out at an atmospheric temperature of 300K at a strain speed of $10^{-3}$/s so that the temperature of the test piece could not be raised by the heat generated in the process of deformation. Due to the foregoing, the temperature of the test piece could be maintained in a temperature range not lower than the point Ms and not higher than the point Md while the test was being performed.

The determination of the martensite phase was measured by the Fisher Ferritescope. Further, polycrystal X-ray diffraction was conducted in order to make investigation into the crystal structure of austenite and martensite and check the value of determination of the martensite phase. In this case, Co—K$\alpha$ rays were used as the source of X-rays.

Figure 1:
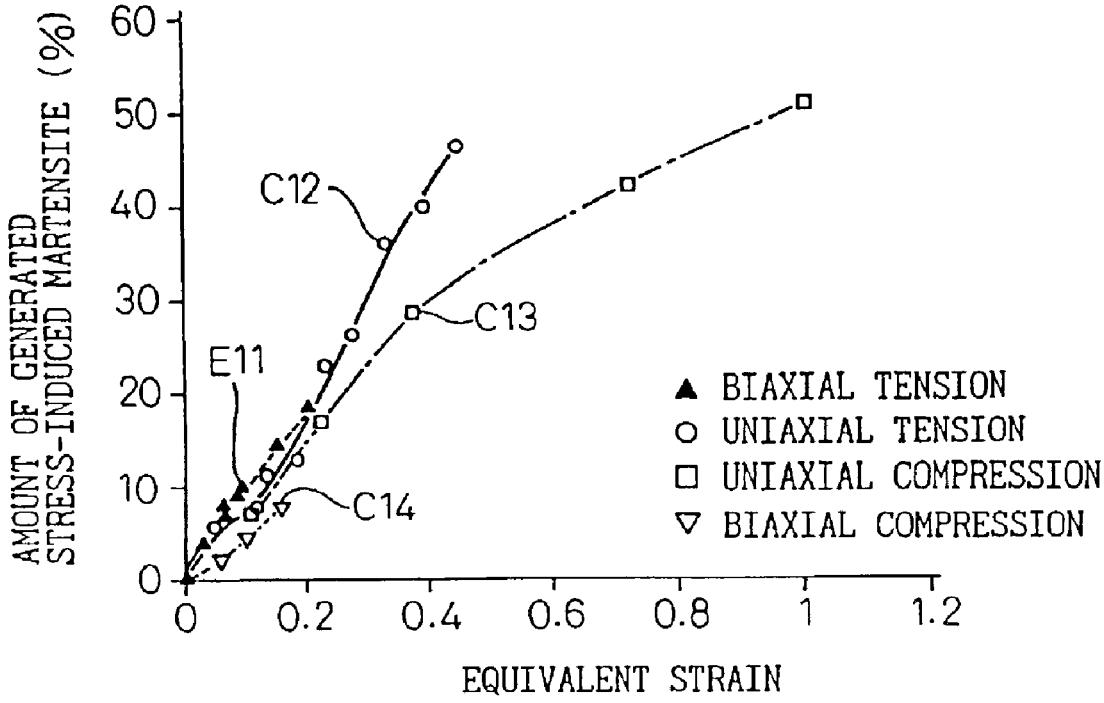
FIG. 1 is a schematic illustration showing a relation between the equivalent strain and the amount of generation of stress induced-martensite of SUS301 with respect to various working methods in Example 1.
Figure 2:
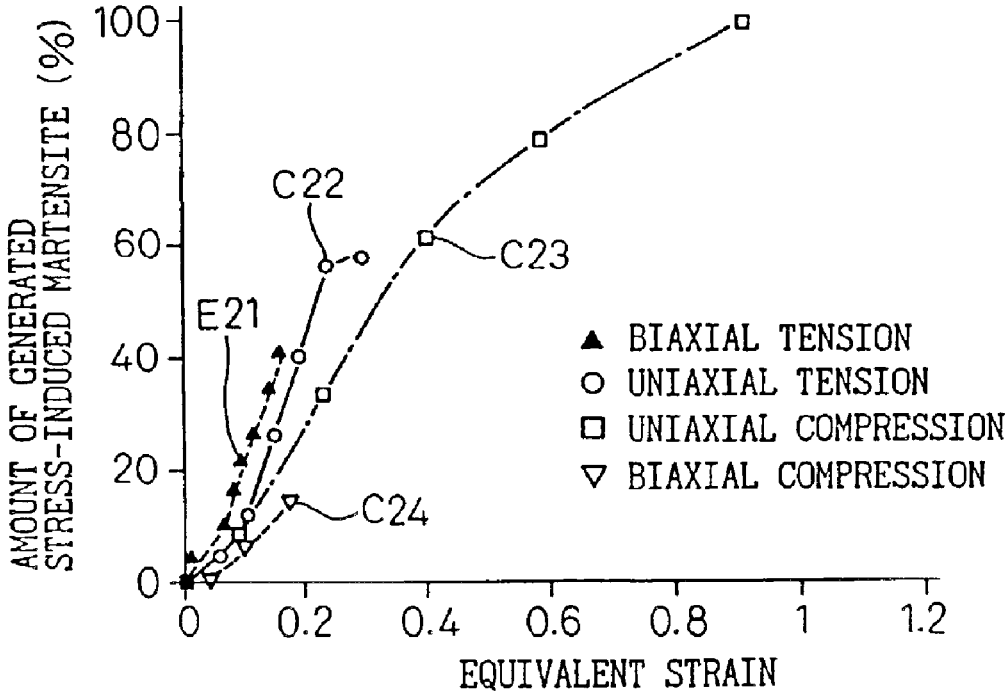
FIG. 2 is a schematic illustration showing a relation between the equivalent strain and the amount of generation of stress induced-martensite of SUS304 with respect to various working methods in Example 1.

The results of the tests are shown in FIGS. 1 and 2.

In both FIGS. 1 and 2, the horizontal axis expresses an equivalent strain, and the vertical axis expresses an amount (%) of the generation of stress induced-martensite. In these drawings, the biaxial tensing is represented by E11 and E21, the uniaxial tensing is represented by C12 and C22, the uniaxial compression was represented by C13 and C23, and the biaxial compression was represented by C14 and C24. FIG. 1 shows the result of the test conducted on SUS301, and FIG. 2 shows the result of the test conducted on SUS304.

As can be seen in FIGS. 1 and 2, in the case of biaxial tensing working, stress induced-martensite was generated at a ratio higher than that of the case of other working. It can be understood that stress induced-martensite tends to be generated in the order of biaxial tensing, uniaxial tensing, uniaxial compression, and biaxial compression in this example.

Due to the foregoing, the following can be understood. In any working method, a ratio of the generation of stress induced-martensite increases when an amount of strain increases. However, when a method is adopted, by which stress is strongly given to the material in a direction so that the volume of the material can increase, the ratio of the generation of stress induced-martensite can more increase.

In this example, evaluation was made by Hirayama's Ni equivalent or Nobara's $M_{d30}$ (K) which are commonly used as a standard to indicate the stress induced-transformation According to the above evaluation, the transformation induced by working tends to occur in SUS301 more than SUS304. However, according to this example, the amount of generation of stress induced-martensite in the case of SUS304 is larger than that of stress induced-martensite in the case of SUS301. It is considered that the reason is a difference of the carbon (C) content between SUS301 and SUS304 (shown on Table 1). Since the carbon content of SUS301 is larger than that of SUS304, SUS301 requires a higher drive power for the transformation induced by working.

Example 2

In order to confirm the result of evaluation of Example 1, an influence of hydrostatic stress with respect to the generation of stress induced-martensite was investigated.

Figure 4:
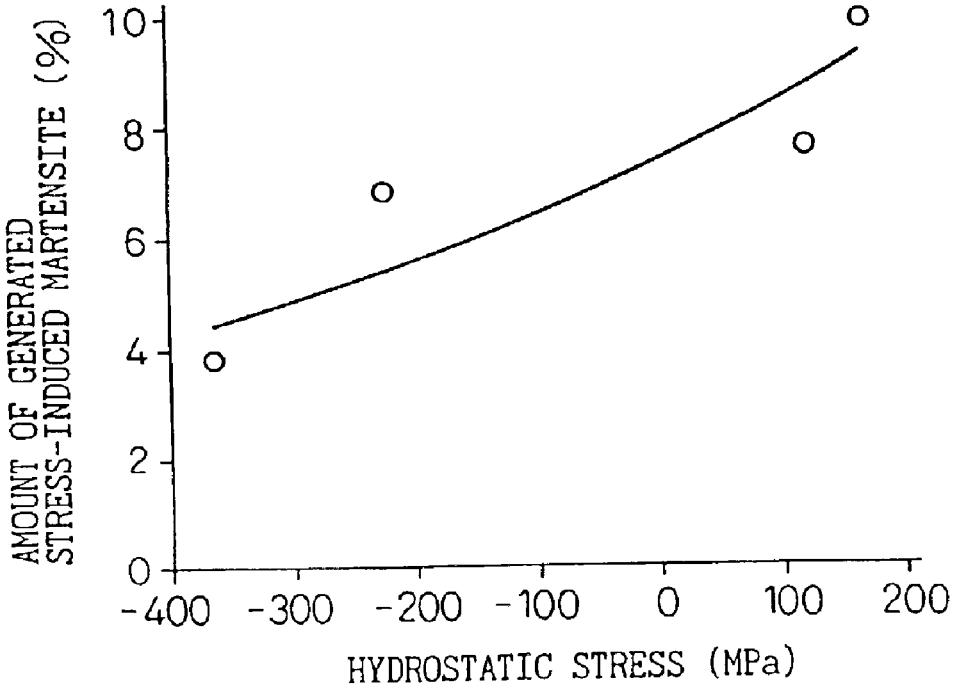
FIG. 4 is a schematic illustration showing a relation between the hydrostatic pressure stress of SUS301 and the amount of generation of stress induced-martensite.

In Example 1, a relation between the hydrostatic stress and the ratio of the generation of stress induced-martensite was found when the equivalent strain was approximately 0.1 in the four types of tests of uniaxial tension, biaxial tension, uniaxial compression, and biaxial compression. FIG. 4 shows a result of the test conducted on SUS301, and FIG. 5 shows a result of the test conducted on SUS304.

Figure 5:
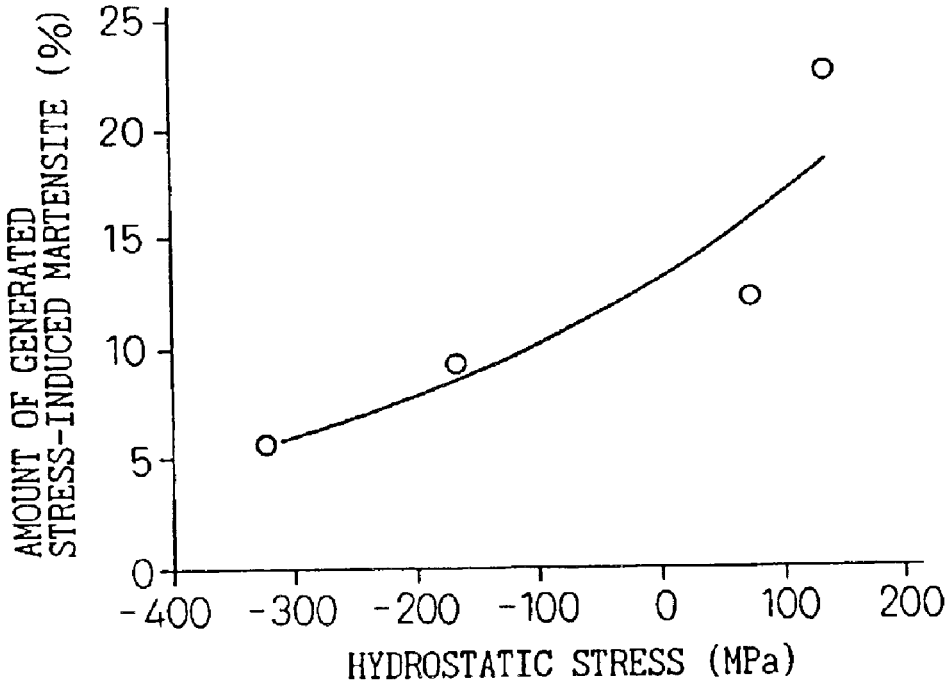
FIG. 5 is a schematic illustration showing a relation between the hydrostatic pressure stress of SUS304 and the amount of generation of stress induced-martensite.

In FIGS. 4 and 5, marks showing the results of the test are arranged in the order of biaxial tension, uniaxial tension, uniaxial compression and biaxial compression from the side on which the hydrostatic stress is high. As can be seen in FIGS. 4 and 5, a ratio of the generation of stress induced-martensite is increased in the order of biaxial tension, uniaxial tension, uniaxial compression and biaxial compression.

According to this example, the following can be noted. When the hydrostatic pressure is high, the generation of stress induced-martensite tends to occur, and the working of biaxial tension is very advantageous for the stress induced-transformation.

Example 3

Next, referring to FIGS. 6 to 12, a method of producing the composite magnetic member of the example of the present invention will be explained below.

Figure 6:
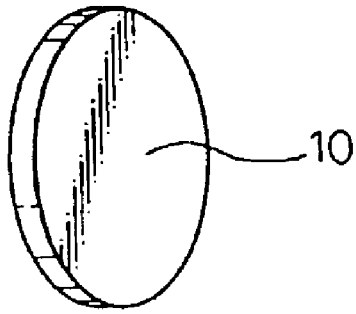
FIG. 6 is a perspective view of the material in Example 3.
Figure 11:
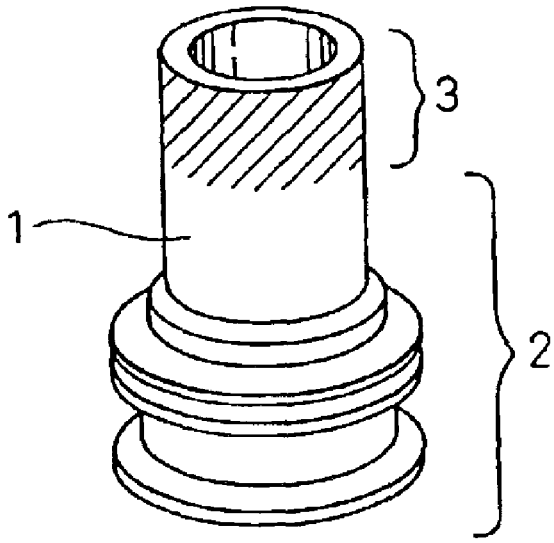
FIG. 11 is a schematic illustration showing a composite magnetic member in Example 3.

As illustrated in FIG. 11, the composite magnetic member 1 to be produced in this example is cylindrical. In an upper half portion of the composite magnetic member 1, there is provided a non-magnetic portion 3, and in a lower half portion, there is provided a ferromagnetic portion 2. When this composite magnetic member 1 is produced, a disk-shaped material 10 illustrated in FIG. 6 is used. This disk-shaped material 10 is made of austenite stainless steel.

Figure 7:
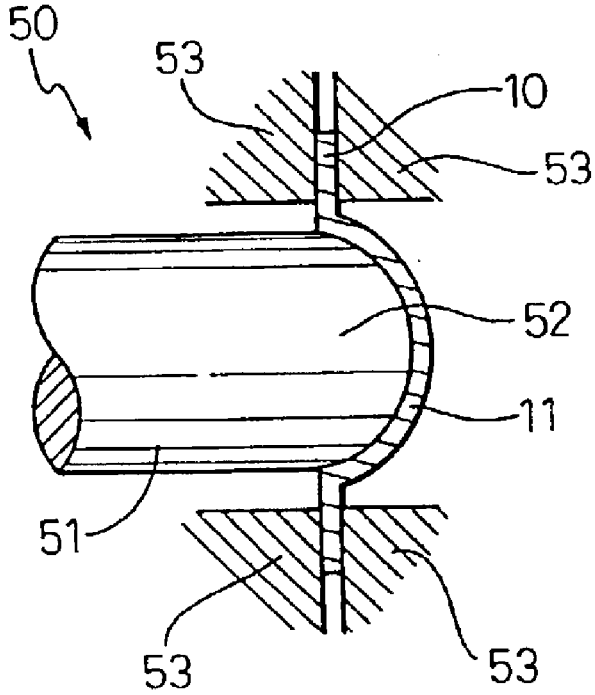
FIG. 7 is a schematic illustration showing a process of bulging in Example 3.
Figure 8:
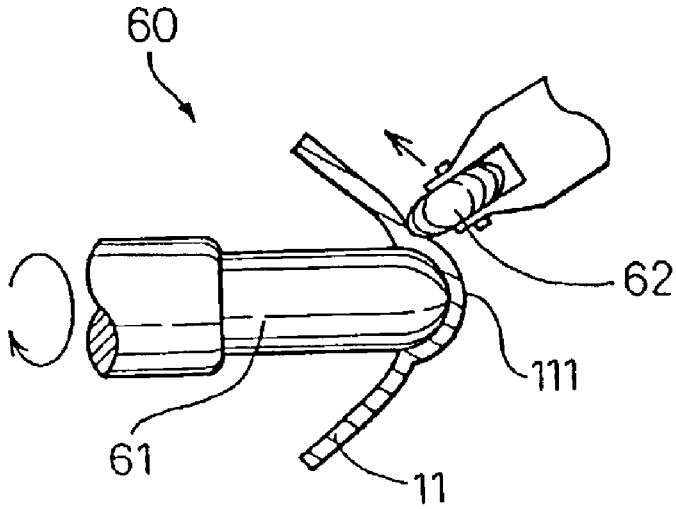
FIG. 8 is a schematic illustration showing an initial condition of spinning in Example 3.
Figure 9:
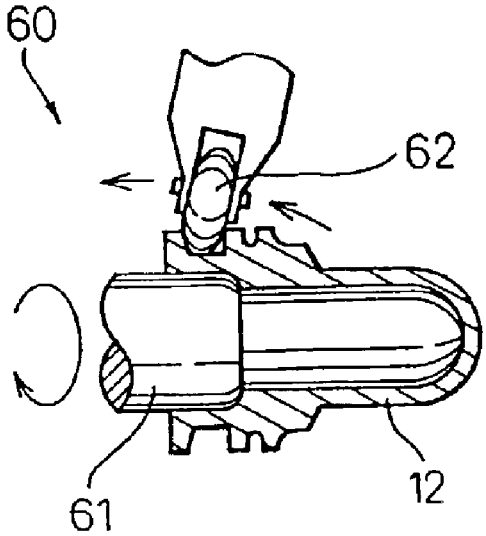
FIG. 9 is a schematic illustration showing a final condition of spinning in Example 3.

Then, as illustrated in FIGS. 7 to 9, the material 10 is subjected to cold working in the temperature range not lower than the point Ms and not higher than the point Md. Due to the above cold working, the non-magnetic austenite phase is transformed into the ferromagnetic martensite phase by the stress induced-transformation, so that the ferromagnetic portion 2 can be formed.

Figure 10:
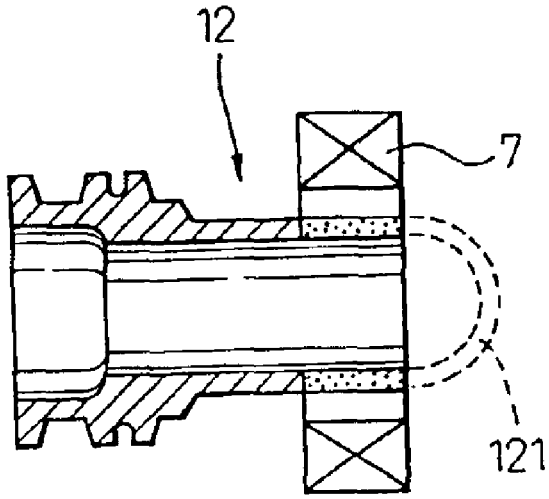
FIG. 10 is a schematic illustration showing a state of solution heat treatment in Example 3.

Next, as illustrated in FIG. 10, a portion of the ferromagnetic portion 2 is subjected to solution heat treatment, and the non-magnetic portion 3 of the austenite phase can be formed.

Due to the foregoing, it is possible to produce a composite magnetic member 1 continuously having the ferromagnetic portion 2 and the non-magnetic portion 3 as illustrated in FIG. 11.

Concerning the cold working of this example, after the biaxial tension working, the uniaxial or biaxial compression working is further conducted.

This cold working will be described below in detail.

First, the material 10 is prepared. As illustrated in FIG. 6, the material 10 is a disk-shaped blank material, which is made of austenite stainless steel, the chemical composition of which is shown on Table 2. The entire material 10 is made of the non-magnetic austenite phase.

TABLE 2

| | C | Si | Mn | P | S | Cr | Ni | Fe |
|---|---|---|---|---|---|---|---|---|
| Chemical Composition | 0.026 | 0.20 | 0.38 | 0.007 | 0.004 | 17.76 | 8.28 | Bal. |

Next, as illustrated in FIGS. 7 to 9, cold working is conducted on the non-magnetic material 10 to cause the stress induced-transformation. This cold working is a combination of bulging, which is the biaxial tension working illustrated in FIG. 7, with spinning which is the uniaxial compression working illustrated in FIGS. 8 and 9.

The cold working is specifically described as follows. As illustrated in FIG. 7, there is provided a bulging device 50 composed of a punch 51 having a spherical portion 52, the radius of which is 25 mm, and also composed of a cramp 53 to hold the material 10. Using this bulging device 50, the material 10 is bulged by a distance of 16 mm, so that the material 10 can be formed into an intermediately formed body 11. In this case, the equivalent strain is 0.25.

Then, cold working is further conducted on the material so as to increase the equivalent strain. As illustrated in FIGS. 8 and 9, the intermediately formed body 11 is subjected to spinning of uniaxial compression by which the degree of working can be enhanced. An outer circumferential portion of the intermediately formed body 11, which has been held by the cramp 53 in the process of bulging, is previously cut off before spinning.

As illustrated in FIGS. 8 and 9, spinning is conducted by a spinning device 60 composed of a forming die 61 rotated together with the intermediately formed body 11 and a moving roller 62. When the moving roller 62 is gradually moved from the fore end portion 111 of the intermediately formed body, spinning is conducted on the intermediately formed body. An amount of the equivalent strain in the processes of bulging and spinning is 0.5.

As described above, the material 10 is subjected to bulging which is a biaxial tension working and also subjected to spinning which is a uniaxial compression working. Due to the foregoing, the material 10 is formed into a second intermediately formed body 12 having a ferromagnetic portion 3 in which martensite induced by working is entirely generated.

Next, as illustrated in FIG. 10, the fore end portion 121 of the second intermediately formed body 12 is cut off, and the upper half is subjected to solution heat treatment conducted by induction heating of a high frequency induction coil 7 for a period of time not more than 10 seconds.

Due to the foregoing, as illustrated in FIG. 11, it is possible to obtain a composite magnetic member 1, the upper half of which is a non-magnetic portion 3, and the lower half of which is a ferromagnetic portion 2.

Next, in this example, in order to evaluate the magnetic characteristic of the obtained composite magnetic material, an amount of the generation of stress induced-martensite in the ferromagnetic portion was measured, and also magnetic flux density $B_{4000}$ was measured. At the same time, the specific magnetic permeability of the non-magnetic portion 3 was measured.

The method of measuring an amount of the generation of stress induced-martensite was the same as that of Example 1.

The result of measurement will be explained below.

An amount of the generation of stress induced-martensite reached 90% in the ferromagnetic portion 2, and the magnetic flux density $B_{4000}$ reached 1.3 T.

For convenience of comparison, the biaxial tension working was not conducted, but only spinning of the uniaxial compression working was conducted to give an equivalent strain 0.5 which was the same as that of this example. In this way, the member to be compared was made. Portions of the member except for the portion subjected to cold working were made in the same manner as that of the member made by the method of producing the composite magnetic member of this example. The same measurement as that described above was conducted on the ferromagnetic portion of the thus obtained member to be compared. As a result of the measurement, the ratio of the generation of stress induced-martensite was approximately 65%, and the magnetic flux density $B_{4000}$ was 0.6 T.

Figure 12:
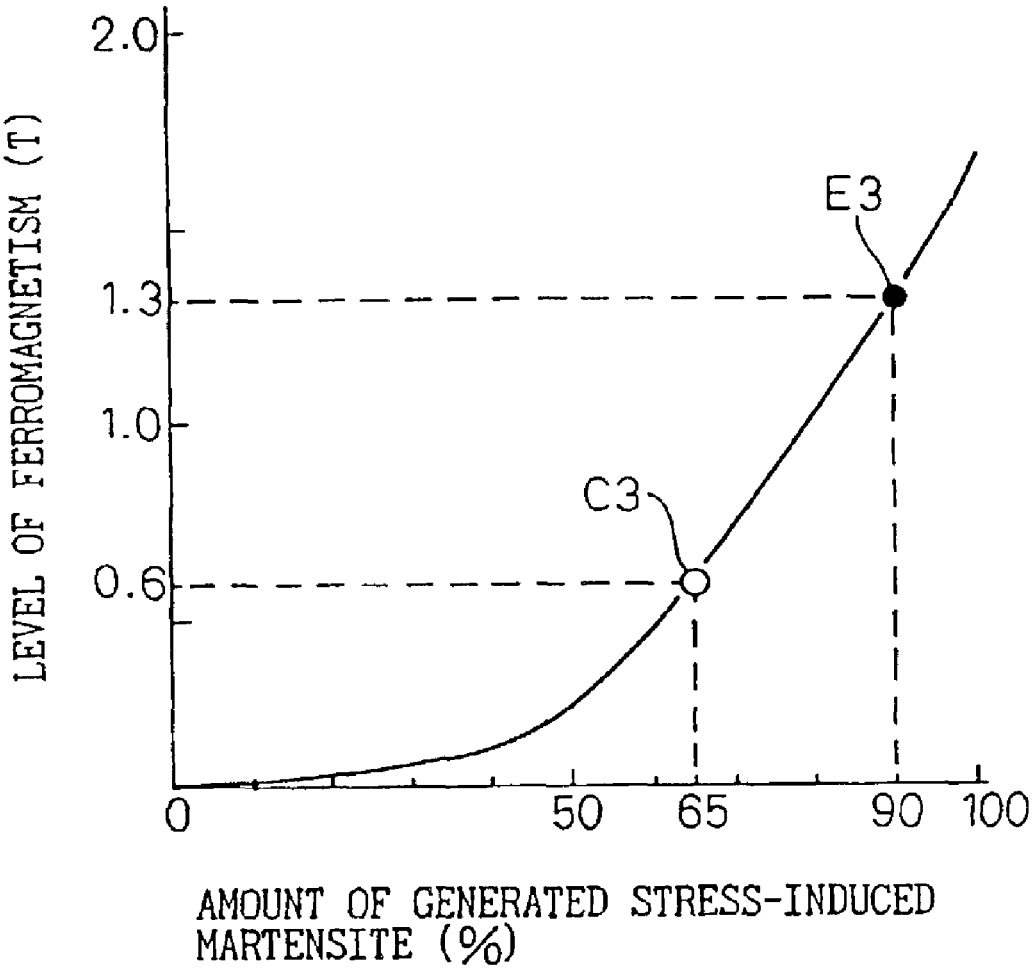
FIG. 12 is a schematic illustration showing a relation between the amount of generation of stress induced-martensite and the level of ferromagnetism.

The above relation is shown in FIG. 12. In FIG. 12, the horizontal axis represents an amount (%) of the generation of martensite induced by working, and the vertical axis represents a ferromagnetism level (magnetic flux density $B_{4000}$). The ferromagnetism level of the ferromagnetic portion in this example is expressed by E3, and the ferromagnetism level of the member to be compared is expressed by C3. As can be seen in FIG. 12, even if the cold working was conducted so that the same equivalent strain of 0.5 could be given, in the case of uniaxial compression working, the ratio of the generation of martensite induced by working was low, and the ferromagnetism level was also low, however, in the case where the biaxial tension working was conducted in this example, the ratio of the generation of martensite induced by working was enhanced and the ferromagnetism level was also enhanced.

Due to the foregoing description, the method of this example is very effective to enhance the magnetic characteristic of the ferromagnetic portion.

The specific magnetic permeability $\mu$ in the nonmagnetic portion 3 was 1.00 to 1.05, that is, the magnetic characteristic of the non-magnetic portion 3 was very excellent.

As described above, in this example, it is possible to easily produce a composite magnetic member 1 having the ferromagnetic portion 2, the ferromagnetic characteristic of which is excellent, and the non-magnetic portion 3, wherein the ferromagnetic portion 2 and the non-magnetic portion 3 are continuously arranged in the composite magnetic member 1.

Example 4

Referring to FIGS. 13A to 17, a method of producing the composite magnetic member of the example of the present invention will be explained below.

Figure 13A:
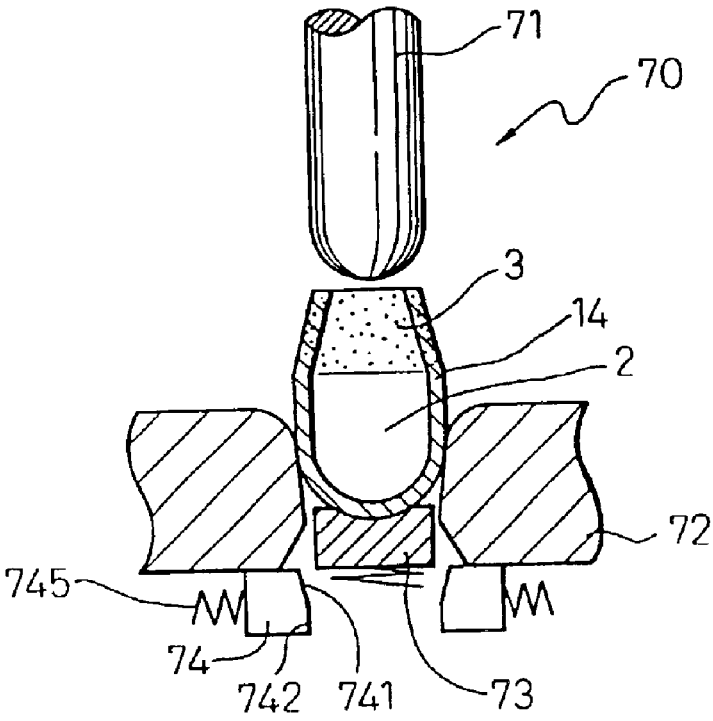
FIG. 13A is a schematic illustration showing a state in which an intermediately formed body is set in a device in Example 1.
Figure 13B:
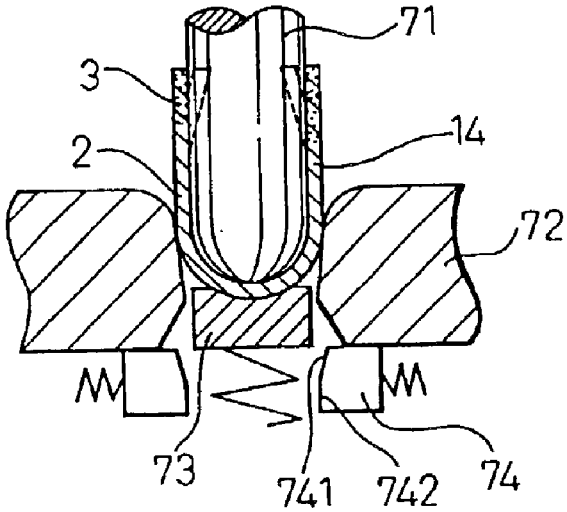
FIG. 13B is a schematic illustration showing a state in which a non-magnetic portion of the intermediately formed body is expanded.

According to the method of producing the composite magnetic member of this example, as illustrated in FIGS. 13A and 13B, first, an intermediately formed body 14, the section of which is formed into a U-shape, is made. This intermediately formed body 14 includes a ferromagnetic portion 2 and a non-magnetic portion 3 which is contracted inward.

Figure 14A:
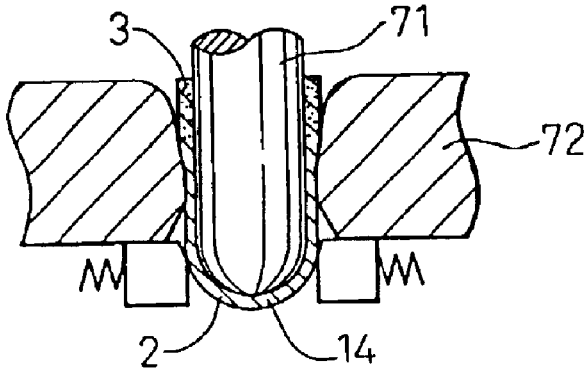
FIG. 14A is a schematic illustration showing a state in which an intermediately formed body is subjected to ironing in Example 1.
Figure 14B:
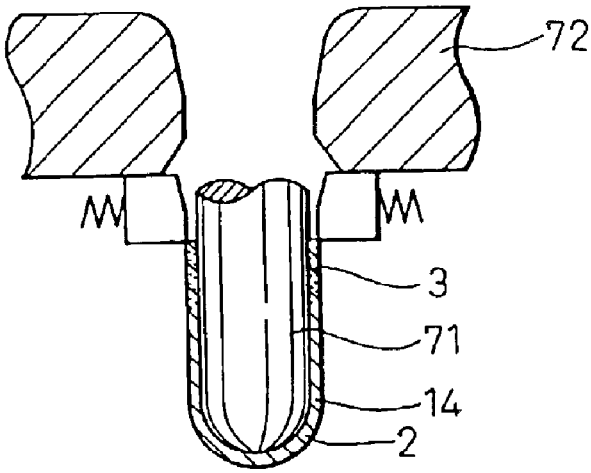
FIG. 14B is a schematic illustration showing a state in which ironing has been completed in Example 1.
Figure 14C:
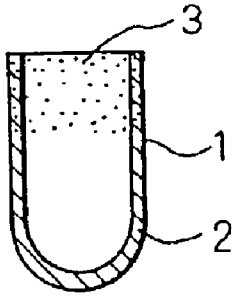
FIG. 14C is a schematic illustration showing a composite magnetic member obtained by ironing in Example 1.

Then, as illustrated in FIGS. 13A and 13B, a punch 71 is inserted into the intermediately formed body 14, so that the non-magnetic portion 3 is expanded. After that, as illustrated in FIGS. 14A and 14B, while the punch 71 is inserted, the intermediately formed body 14 is subjected to ironing so that the residual tensile stress can be changed into a residual compressive stress in the non-magnetic portion 3. Due to the foregoing, the composite magnetic member 1 can be obtained as illustrated in FIG. 14C.

The following are the detailed descriptions.

Figure 15A:
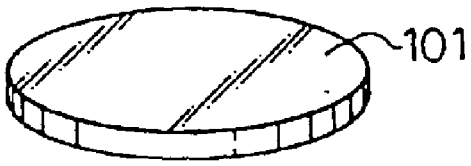
FIGS. 15A to 15F are schematic illustrations showing a procedure of producing an intermediately formed body in Example 1.
Figure 15B:
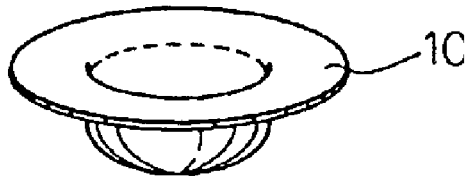
Figure 15C:
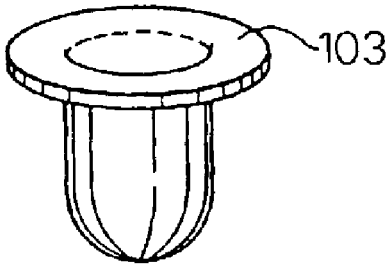

The intermediately formed body 14 is made of an austenite alloy steel sheet 101 shown in FIG. 15A, the composition of which is specifically described as follows.

C is not more than 0.6 weight %, Cr is 12 to 19 weight %, Ni is 6 to 12 weight %, Mn is not more than 2 weight %, and the residual portion is composed of Fe and inevitable impurities, wherein Hirayama's Equivalent Heq=[Ni %]+1.05 [Mn %]+0.65 [Cr %]+0.35 [Si %]+12.6 [C %] is 20 to 23%, and the nickel equivalent Nieq=[Ni %]+30 [C %]+0.5 [Mn %] is 9 to 12%, and the chromium equivalent Creq=[Cr %]+[Mo %]+1.5 [Si %]+0.5 [Nb %] is 16 to 19%.

Figure 15D:
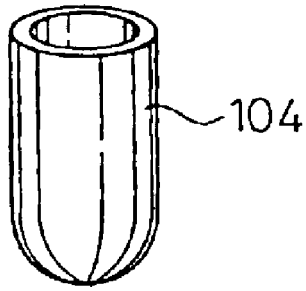
Figure 15E:
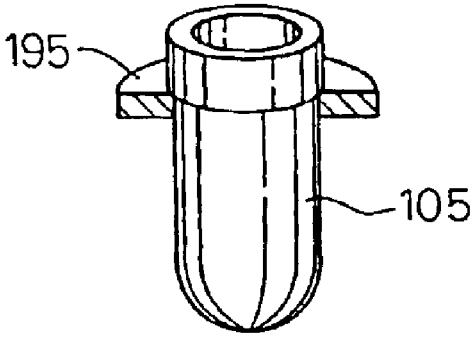
Figure 15F:
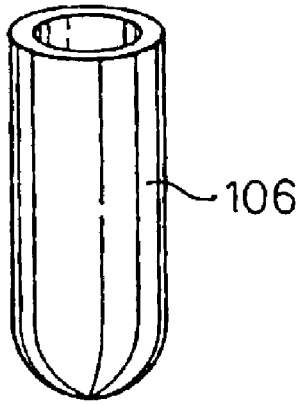

Then, as illustrated in FIGS. 15A to 15D, the above steel sheet 101 is subjected to deep drawing and formed into a body 104, the section of which is U-shaped as illustrated in FIG. 15D. Next, as illustrated in FIG. 15E, this body is subjected to drawing with ironing by a plurality of times using a die 195. In this way, an entirely ferromagnetic U-shaped member 106 is obtained as illustrated in FIG. 15F. In this example, the inner diameter of the U-shaped member 106 is 7.05 mm, and the thickness is 0.86 mm.

Figure 16:
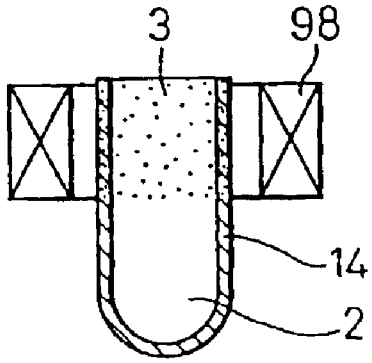
FIG. 16 is a schematic illustration showing a state in which a non-magnetic portion is formed in an intermediately formed body in Example 1.

Then, as illustrated in FIG. 16, a portion of the U-shaped member 106 on the opening side is subjected to solution annealing with a high frequency induction heating device 98. Due to the foregoing, it is possible to obtain an intermediately formed body 14 in which the ferromagnetic portion 2 and the non-magnetic portion 3 are continuously arranged.

As illustrated in FIGS. 13A, 21C and 21D, the non-magnetic portion 3 of this intermediately formed body 14 is contracted inward by the influence of transformation of the phase. Specifically, the minimum inner diameter of the non-magnetic portion 3 is 7.02 mm. In this case, the size of the ferromagnetic portion 2 is the same as that of the above U-shaped member 106.

Next, there is provided an explanation for a device 5 to conduct expansion and drawing with ironing on the above non-magnetic portion 3. As illustrated in FIGS. 13A, 13B and 14A to 14C, the device 5 to conduct expansion and ironing includes a punch 71 used for press-fitting and ironing, and a die 72 used for drawing with ironing. The outer diameter of the punch 71 is 7.08 mm, which is larger than the inner diameter of the main body by 0.03 mm.

The inner diameter of the die 72 is 8.68 mm. Therefore, when the intermediately formed body 14 is subjected to ironing, an amount of ironing is set at 0.06 mm, that is, a ratio of ironing is set at about 7%.

As illustrated in FIGS. 13A and 13B, inside the die 72, there is provided a cushion plate 73 to support the intermediately formed body 14 when the punch 71 is press-fitted into the intermediately formed body 14. This cushion plate 73 is supported by the back pressure of 500 kgf/cm$^2$, so that the intermediately formed body 14 can be positively supported by this cushion plate 73 when the punch 71 is press-fitted.

The cushion plate 73 is arranged in such a manner that it is located inside the die 72 only in the case of press-fitting, and withdrawn to a position where the cushion plate 73 can not interfere with the movement of the punch 71 in the case of ironing.

On the delivery side of the die 72, there are provided a pair of knockout portions 74 to remove an intermediately formed body, which has already been subjected to ironing, from the punch 71. These knockout portions 74 are supported by springs 745 arranged outside of them in such a manner that the knockout portions 74 can be withdrawn.

In order to withdraw the knockout portion 74 to the outside easily in the case of ironing, there is provided a tapered portion 741 on the side of the die 72. On the opposite side, there is provided a right-angled engaging angle portion 742 which engages with the opening end portion of the intermediately formed body after the completion of drawing with ironing.

The non-magnetic portion 3 of the intermediately formed body 14 is expanded and drawn with ironing by the above device 70 as follows. First, as illustrated in FIG. 13A, the intermediately formed body 14 is set at the center of the die 72 and made to come into contact with the cushion plate 73. Then, the punch 71 is made to advance. Since the intermediately formed body 14 is supported by the cushion plate 73 in this case, the punch 71 is press-fitted into the intermediately formed body 14.

Due to the foregoing, inside diameters of both the ferromagnetic portion 2 and the non-magnetic portion 3 of the intermediately formed body 14 are expanded to be the same value as that of the outer diameter of the punch 71.

Next, the cushion plate 73 is withdrawn and the punch 71 is further advanced.

Due to the foregoing, as illustrated in FIG. 14A, the intermediately formed body 14 is drawn with ironing by a ratio of about 7% while the knockout portions 74 are being drawn outside. Then, as illustrated in FIG. 14B, at the completion of ironing, the knockout portions 74 are advanced inward by the pushing forces of the springs 745.

Therefore, when the punch 71 is withdrawn in this condition, the engaging angle portion 742 of the knockout portion 74 comes into contact with the end portion of the opening of the intermediately formed body. When the punch 71 is further withdrawn, the intermediately formed body is removed from the punch 71. In this way, the composite magnetic member 1 is obtained as illustrated in FIG. 14C.

Concerning the thus obtained composite magnetic member 1, the outside diameter and inside diameter of the ferromagnetic portion 2 are the same as those of the non-magnetic portion 3, and the residual tensile stress is released. The result of measurement of the residual stress is shown in FIG. 17.

Figure 17:
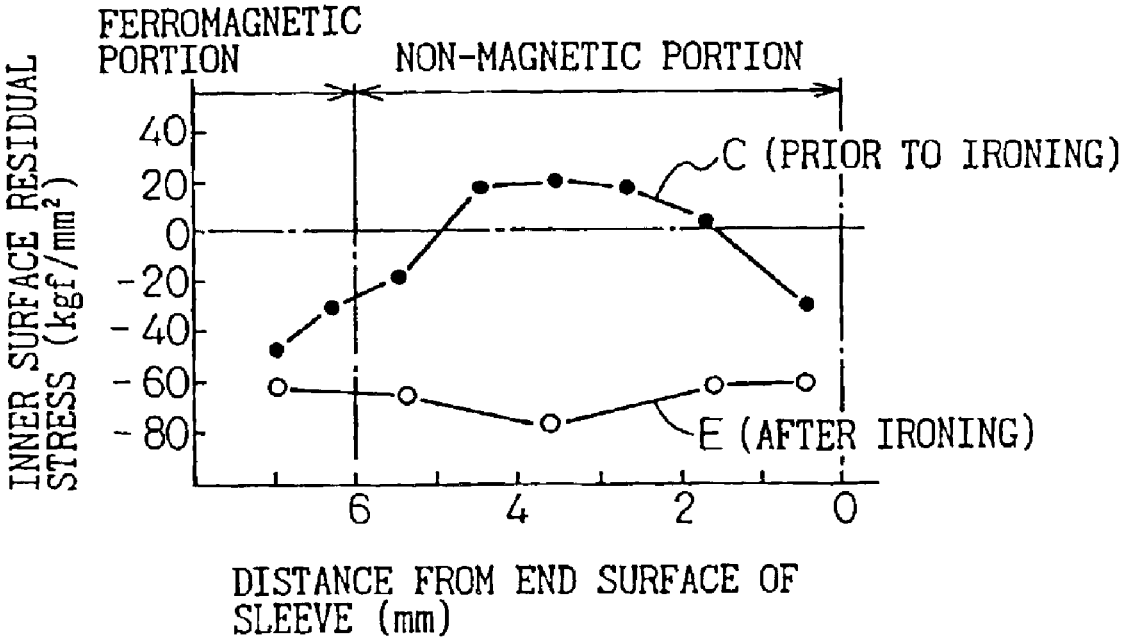
FIG. 17 is a schematic illustration showing a state of residual stress before and after ironing in Example 1.

In FIG. 17, the horizontal axis represents a distance from the end portion of the opening of the composite magnetic member, and the vertical axis represents a residual stress on the inside of the composite magnetic member. A state before ironing is represented by reference mark C, and a state after ironing is represented by reference mark E.

As can be seen in FIG. 17, a residual tensile stress generated before ironing was completely released and changed into a residual compressive stress, which was advantageous in preventing the occurrence of stress corrosion cracks.

The magnetic characteristic of the obtained composite magnetic member was evaluated. As a result of evaluation, the magnetic characteristic was very excellent as follows. The ferromagnetic level in the ferromagnetic portion 2 was not lower than 0.3 T, and the non-magnetic level in the non-magnetic portion 3 was that the specific magnetic permeability $\mu$ was not higher than 1.2.

Next, the thus obtained composite magnetic member 1 was subjected to the stress corrosion cracking test. The testing method is described below. After test pieces had been dipped in the boiling liquid of $MgCl_2$ for 120 minutes, they were observed to check the occurrence of cracks. As a result of the test, no cracks were found, that is, the anti-stress corrosion cracking property was very high.

Example 5

In this example, the intermediately formed body was made in the same manner as that of Example 4, and then a ratio of ironing was variously changed in the process of ironing, so that an influence of the ratio of ironing was investigated. Concerning the intermediately formed body, the following two types of intermediately formed bodies were prepared. One was an intermediately formed body, the composition of material (material E1) of which was the same as that of Example 4. The other was an intermediately formed body, in the composition of material (material E2) of which, the Hirayama's Equivalent was changed from 20% to 21%. Other points are the same as those of Example 4.

Concerning a ratio of ironing, as shown in Table 3, an amount of ironing was changed from 0.02 to 0.08 mm by changing the inner diameter of the die 72. Due to the foregoing, the ratio of ironing was changed from 2.3% to 9.3%.

Next, at each ratio of ironing, by the same method as that of Example 4, the magnetic characteristic and the residual stress were measured with respect to each composite magnetic member obtained in the above way, and also each composite magnetic member was subjected to the stress corrosion cracking test.

Concerning the magnetic characteristic, the specific magnetic permeability $\mu$ in the non-magnetic portion 3 was measured, and the magnetic characteristic was evaluated by this specific magnetic permeability. In order to give consideration to the seasonal variations, the above evaluation was made at the two atmospheric temperatures of 22° C. and 40° C. In this connection, concerning the characteristic of the ferromagnetic portion, from the theoretical viewpoint, there was no possibility that the characteristic of the ferromagnetic portion was deteriorated by the above working, which was confirmed in an experiment made by the inventors.

The result of measurement of the specific magnetic permeability of the non-magnetic portion is shown on Table 4. As can be seen on the table, in some test pieces of material E1, the specific magnetic permeability $\mu$ exceeded 1.20 slightly. However, in general, the specific magnetic permeability $\mu$ was maintained at a value not higher than 1.20 which was the target. Therefore, it can be concluded that the characteristic of the non-magnetic portion was excellent.

Next, the residual stress was measured in the boundary between the non-magnetic portion 3 and the ferromagnetic portion 2 of each composite magnetic member. This measurement was made on the inner surface of each composite magnetic member. The result of measurement is shown on Table 5. As can be seen on the table, the residual tensile stress was changed into the residual compressive stress in any material and condition, that is, it was possible to provide a very good state.

Next, each composite magnetic member was subjected to the stress corrosion cracking test. In this case, the test conditions were the same as those of Example 4. In order to give consideration to the seasonal factors, the test was made at the two atmospheric temperatures of 22° C. and 40° C.

The result of measurement is shown on Table 6. As can be seen on the table, the result was good in any material and condition, and no cracks were caused in the test.

According to the above results of the test, the following can be concluded. When the intermediately formed body is drawn with ironing at a ratio of 2 to 9%, it is possible to provide a composite magnetic member, the stress corrosion cracking characteristic of which is remarkably enhanced while the performance of the ferromagnetic portion and the non-magnetic portion can be maintained in the intermediately formed body.

In this connection, in Examples 4 and 5, the section of the intermediately formed hollow body was formed into a U-shape, and also the section of the thus obtained composite magnetic hollow body was formed into a U-shape. However, the shape is not limited to the specific example, for example, when the shape is hollow and there is provided no bottom, it is possible to obtain the same effect.

TABLE 3

| Inner Diameter of Die (mm) | Amount of Drawing with Ironing (mm) | Ratio of Drawing with Ironing (%) |
|---|---|---|
| 8.76 | 0.02 | 2.3 |
| 8.72 | 0.04 | 4.6 |
| 8.68 | 0.06 | 7.0 |
| 8.64 | 0.08 | 9.3 |

TABLE 4

| Material | Temperature | Ratio of Ironing | Specific Magnetic Permeability $\mu$ First | Second | Average |
|---|---|---|---|---|---|
| E1 | 22° C. | 2.3% | 1.164 | 1.065 | 1.115 |
| | | 4.6% | 1.060 | 1.091 | 1.076 |
| | | 7.0% | 1.260 | 1.132 | 1.196 |
| | | 9.3% | 1.270 | 1.270 | 1.270 |
| E2 | 22° C. | 2.3% | 1.036 | 1.116 | 1.076 |
| | | 4.6% | 1.045 | 1.041 | 1.043 |
| | | 7.0% | 1.032 | 1.075 | 1.054 |
| | | 9.3% | 1.168 | 1.170 | 1.169 |
| E1 | 40° C. | 2.3% | 1.040 | 1.040 | 1.040 |
| | | 4.6% | 1.060 | 1.110 | 1.085 |
| | | 7.0% | 1.190 | 1.100 | 1.145 |
| | | 9.3% | 1.100 | 1.200 | 1.150 |
| E2 | 40° C. | 2.3% | 1.020 | 1.030 | 1.025 |
| | | 4.6% | 1.020 | 1.030 | 1.025 |
| | | 7.0% | 1.030 | 1.080 | 1.055 |
| | | 9.3% | 1.070 | 1.090 | 1.080 |

TABLE 5

Result of Measurement of Residual Stress

| Material | Amount of Ironing (Ratio of Ironing) 0.02 mm (2.3%) | 0.06 mm (7.0%) | 0.08 mm (9.3%) |
|---|---|---|---|
| E1 | −10 Kgf/mm$^2$ | −30 Kgf/mm$^2$ | −30 Kgf/mm$^2$ |
| E2 | — | −25 Kgf/mm$^2$ | — |

TABLE 6

Result of Test of Stress Corrosion Cracks

| Material | Temperature | Amount of Ironing (Ratio of Ironing) | Result of Test of Stress Corrosion Cracks (Number of cracked pieces/Number of tested pieces) Inside | Outside | Judgment |
|---|---|---|---|---|---|
| E1 | 22° C. | 0.02 mm (2.3%) | 0/3 | 0/3 | ○ |
| | | 0.04 mm (4.6%) | 0/3 | 0/3 | ○ |
| | | 0.06 mm (7.0%) | 0/10 | 0/10 | ○ |
| | | 0.08 mm (9.3%) | 0/3 | 0/3 | ○ |
| | 40° C. | 0.02 mm (2.3%) | 0/2 | 0/2 | ○ |
| | | 0.04 mm (4.6%) | 0/3 | 0/3 | ○ |
| | | 0.06 mm (7.0%) | 0/3 | 0/3 | ○ |
| | | 0.08 mm (9.3%) | 0/3 | 0/3 | ○ |
| E2 | 22° C. | 0.02 mm (2.3%) | 0/3 | 0/3 | ○ |
| | | 0.04 mm (4.6%) | 0/3 | 0/3 | ○ |
| | | 0.06 mm (7.0%) | 0/10 | 0/10 | ○ |
| | | 0.08 mm (9.3%) | 0/3 | 0/3 | ○ |

TABLE 6-continued

Result of Test of Stress Corrosion Cracks

| Material | Temperature | Amount of Ironing (Ratio of Ironing) | Result of Test of Stress Corrosion Cracks (Number of cracked pieces/Number of tested pieces) Inside | Outside | Judgment |
|---|---|---|---|---|---|
| | 40° C. | 0.02 mm (2.3%) | 0/2 | 0/2 | ○ |
| | | 0.04 mm (4.6%) | 0/3 | 0/3 | ○ |
| | | 0.06 mm (7.0%) | 0/3 | 0/3 | ○ |
| | | 0.08 mm (9.3%) | 0/2 | 0/2 | ○ |

Example 6

Figure 18:
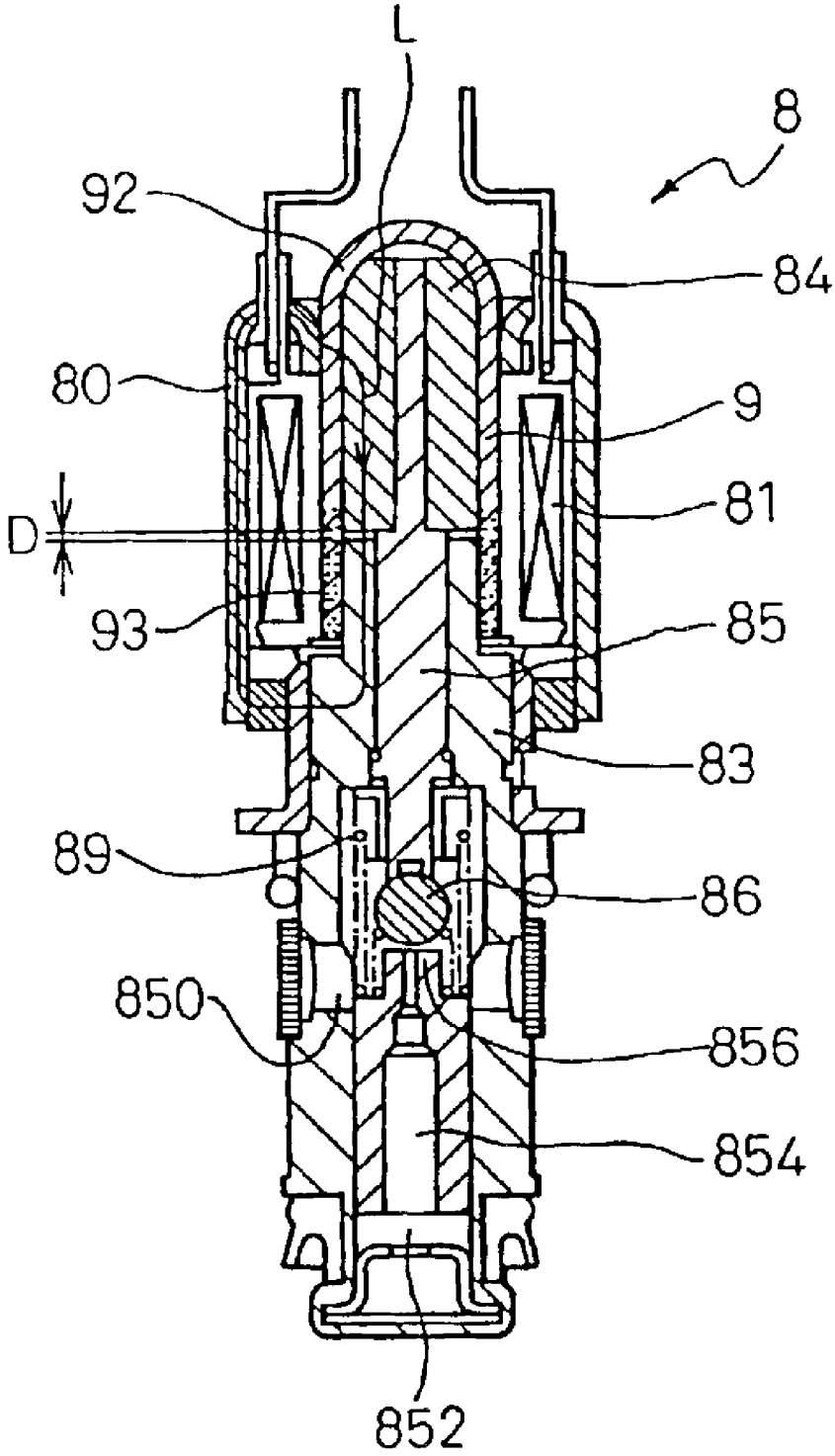
FIG. 18 is a cross-sectional view of an electromagnetic valve in Example 3.

In this example, as illustrated in FIG. 18, the composite magnetic member made by the method of Example 4 was applied to a sleeve 9 which was one of the parts of the electromagnetic valve 8. This specific example will be explained as follows. This electromagnetic valve 8 is commonly used in an automobile for the purpose of controlling the communication of a hydraulic passage.

As illustrated in FIG. 18, the electromagnetic valve 6 is controlled in such a manner that a communicating condition of the hydraulic passage composed of an inlet 852 and an outlet 850 formed in the ferromagnetic stator 83 is opened and closed by a valve seat 856 having a communicating hole 854 and also by a ball 86 coming into contact with the valve seat 856.

The ball 86 is attached to a fore end portion of the shaft 85 slidably arranged in the stator 83. This shaft 85 is connected to a plunger 84. On the other hand, on the fore end side of the stator 83, there is provided a sleeve 9, the section of which is formed into a U-shape. This sleeve 9 is a composite magnetic member. In the sleeve 8, a plunger 84 is slidably arranged.

This plunger 84 can be moved by a distance D, which is a moving space D formed between the stator 83 and the plunger 84 illustrated in FIG. 18. This moving space D can be maintained by a pushing force of the spring 89 arranged at the lower end of the shaft 85.

Outside the sleeve 9, there is provided a coil 81 which is arranged coaxially to the sleeve 9. Further outside the coil 81, there is provided a ferromagnetic yoke 80 which covers the coil 81. This yoke 80 is connected to both the sleeve 8 and the stator 83.

As described above, the sleeve 8 is composed of a composite magnetic member. The main body located on the bottom side is a ferromagnetic portion 92, and the opening end side is a non-magnetic portion 93. In a portion in which the moving space D is formed between the plunger 84 and the stator 94, the non-magnetic portion 93 is located in such a manner that the non-magnetic portion 93 covers the moving space D.

In the electromagnetic valve composed as described above, in the case of closing the hydraulic circuit, the above coil 81 is energized with electric current, so that it can be excited. Due to the foregoing, as illustrated in FIG. 18, there is formed a magnetic circuit L composed of the yoke 80 which is a ferromagnetic body, the ferromagnetic portion 92 of the sleeve 9, the plunger 84, the stator 83 and the yoke 80. When the above magnetic circuit L is formed, an attraction force is generated between the plunger 84 and the stator 83 which are ferromagnetic bodies, so that the plunger 84 and the shaft 85 are moved while resisting a pushing force generated by the spring 89. Due to the foregoing, the ball 86 attached to the fore end of the shaft 85 comes into contact with the valve seat 856, and the hydraulic circuit is shut off.

In order to open the hydraulic circuit, supply of the electric current to the coil 81 is stopped. Due to the foregoing, the above magnetic circuit is extinguished. Therefore, by the force of the spring 89, the shaft 85 and the plunger 84 are returned to the initial positions. At the same time, the ball 86 is released from the valve seat 856. As a result, the hydraulic passage can be communicated.

In this electromagnetic valve 8, when the ferromagnetic characteristic of the ferromagnetic portion 92 is low, it is impossible to form a strong magnetic circuit, and when the specific magnetic permeability of the non-magnetic portion 93 is too high, a magnetic circuit is formed which avoids passing through the moving space D and passes through the non-magnetic portion 73. Since the magnetic circuit is formed in the above manner, no attraction force is generated between the plunger 84 and the stator 83.

For the reasons described above, the magnetic characteristics of both the ferromagnetic portion 92 and the non-magnetic portion 93 are very important factors to determine the performance of the electromagnetic valve 8.

It is demanded that the electromagnetic valve 8 is highly durable. One of the characteristics to determine the durability is the stress corrosion cracking resistance property.

In order to enhance the stress corrosion cracking resistance property, the sleeve 9 of the electromagnetic valve 8 of this example was produced by the method described in Example 4. Therefore, while the performance of the ferromagnetic portion and the non-magnetic portion is maintained high, the stress corrosion cracking resistance property can be greatly enhanced. Therefore, the performance of the electromagnetic valve 8 into which the above sleeve 9 is incorporated is high, and it is highly durable.

Example 7

Figure 19:
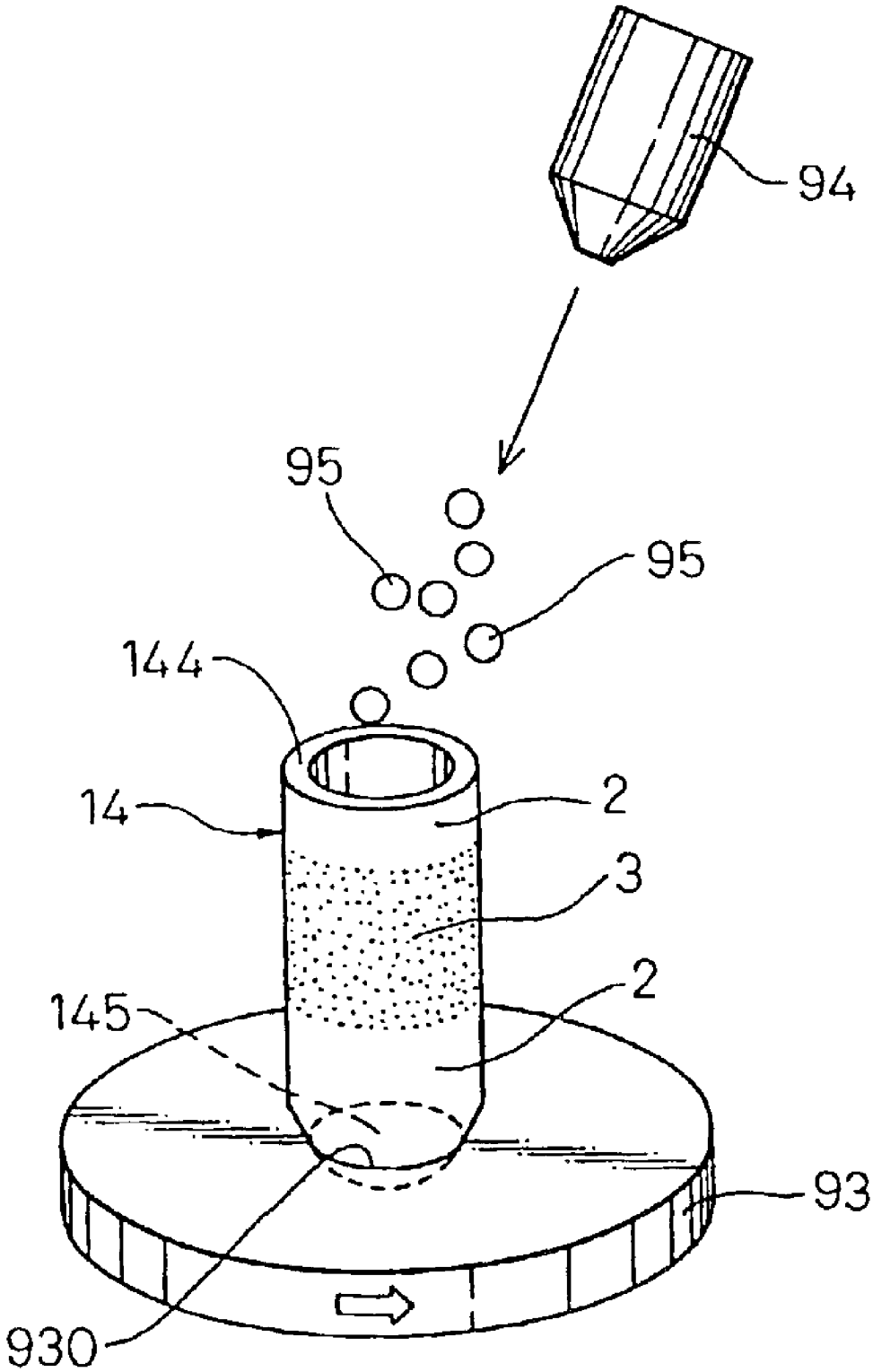
FIG. 19 is a schematic illustration showing a process of shot peening in Example 4.
Figure 20:
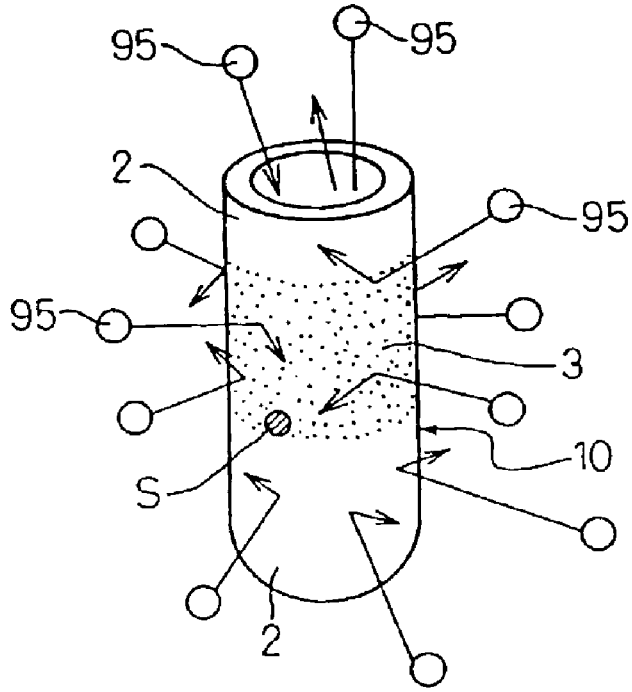
FIG. 20 is a schematic illustration showing a state in which shot particles are colliding with an intermediately formed body in Example 4.

As illustrated in FIG. 19, this is a specific example in which an intermediately formed body 14 made by the same method as that of Example 4 was used, and the intermediately formed body 14 was subjected to shot peening to remove the residual tensile stress. As illustrated in FIGS. 19 and 20, in the intermediately formed body 14 of this example, both the opening end portion 144 and the bottom portion 145 are formed into ferromagnetic portions 2, and a non-magnetic portion 3 is provided between these ferromagnetic portions.

As illustrated in FIG. 19, shot peening is conducted in this example when the intermediately formed body 14 is set at the center of a rotary table 93. On the rotary table 93, there is formed a setting hole 930 at the center, and the bottom portion 145 of the intermediately formed body 14 is inserted into the setting hole 930 so that the intermediately formed body 14 can be perpendicularly arranged.

Next, while the rotary table 93 is rotated, shot particles 95 are shot out from a nozzle 94 and made to collide with the inside and the outside of the intermediately formed body 14. In this example, particles of #300 made of SUS304 were used as the shot particles 95. Also, in this example, air pressure used for shooting the shot particles 95 was set at 0.2 to 0.5 MPa. The processing time of peening was set at 5 to 30 seconds.

FIG. 20 is a view showing a state of collision of the shot particles 95 against the intermediately formed body 14. As illustrated in FIG. 20, the shot particles 95 are made to substantially uniformly collide with the inside and the outside of the intermediately formed body 14. Therefore, the shot particles 95 are made to collide with a portion where the residual tensile stress is generated. In this connection, the shot particles 95 may be made to collide with only a portion where the residual tensile stress is generated, however, in this example, the shot particles 95 were made to uniformly collide with the above portion where the residual tensile stress is generated and also its peripheral portion.

By the collision of the above shot particles 95, the intermediately formed body 14 is substantially uniformly given a compressive force. Therefore, in the portion where the residual tensile stress is given, the residual tensile stress is gradually reduced. Due to the foregoing, after the completion of shot peening, the residual tensile stress in the intermediately formed body 14 is greatly reduced, so that the stress corrosion cracking resistance property can be greatly enhanced.

In order to clarify this effect, in this example, the residual stress in the intermediately formed body 14 was measured before and after the processing of shot peening. The measuring point is located on the inner circumferential surface side of the portion indicated by mark S in FIG. 20. The measurement was conducted in the direction of thickness of the intermediately formed body 14. That is, the measurement was conducted from the inner circumferential surface to a position, the depth of which was approximately 120 $\mu$m from the inner circumferential surface in the direction of thickness.

Figure 21:
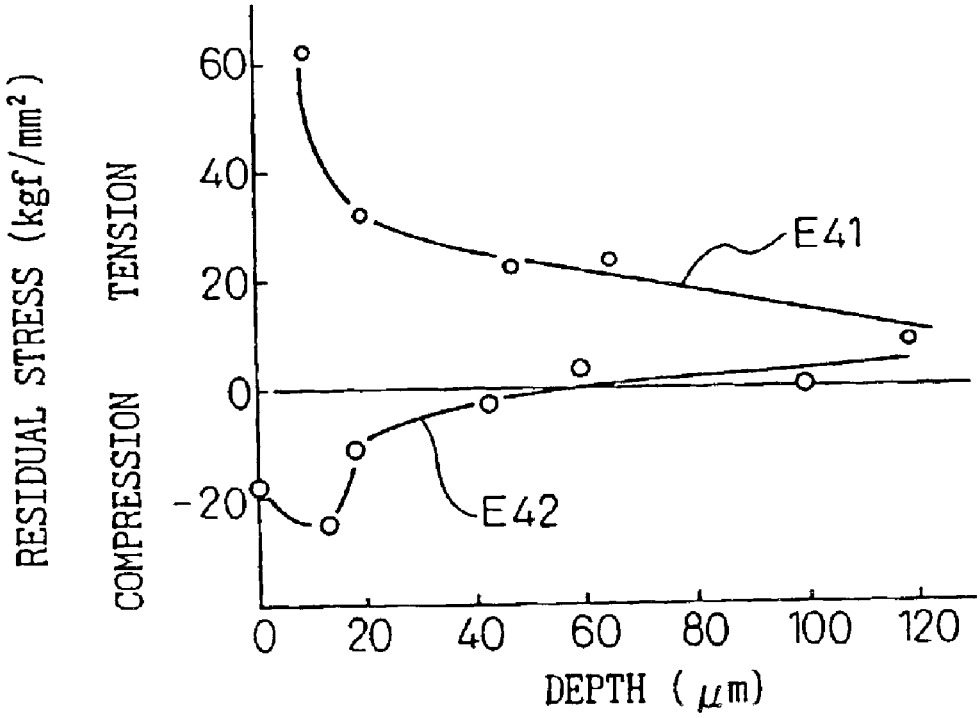
FIG. 21 is a schematic illustration showing a change in the residual stress in an intermediately formed body in Example 4.
Figure 22A:
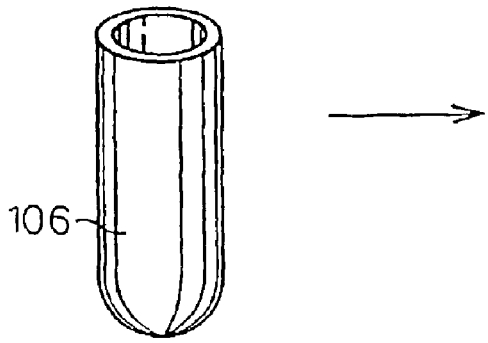
FIGS. 22A and 22B are schematic illustrations showing a method of forming a non-magnetic portion of a composite magnetic member in the conventional example.
Figure 22B:
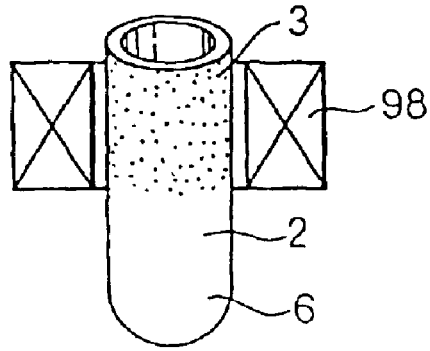
RELATED ART Fig.22B
Figure 22C:
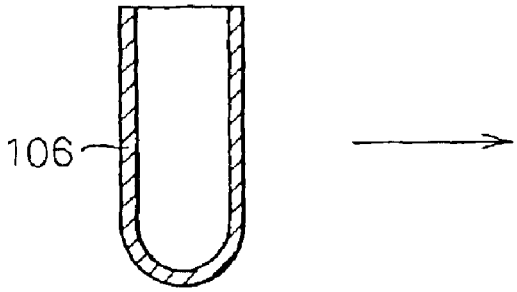
RELATED ART Fig.22C
FIGS. 22C and 22D are schematic illustrations showing a change in the shape of a non-magnetic portion when it is formed.
Figure 22D:
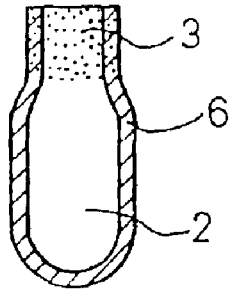
RELATED ART Fig.22D
Figure 23:
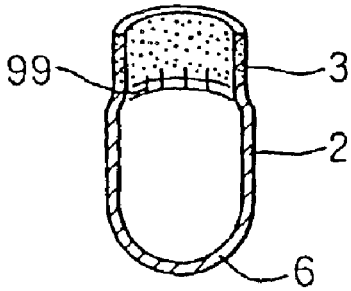
RELATED ART Fig.23
FIG. 23 is a schematic illustration showing a state of generation of stress corrosion in the conventional example.
Figure 24A:
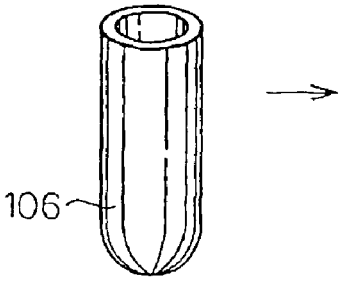
FIGS. 24A to 24C are schematic illustrations showing a method of correcting a shape in the conventional example.
Figure 24B:
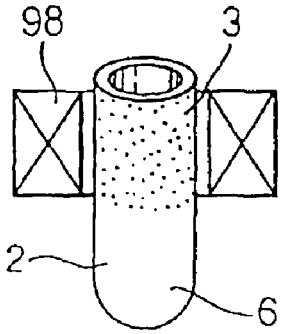
RELATED ART Fig.24B
Figure 24C:
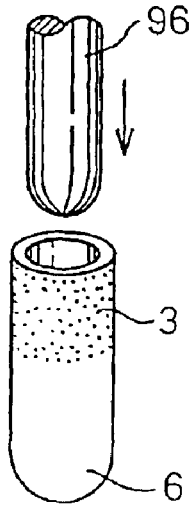
RELATED ART Fig.24C
Figure 25A:
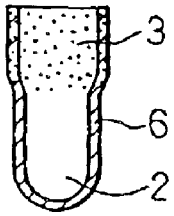
RELATED ART Fig.25A
FIG. 25A is a schematic illustration showing a state in which a non-magnetic portion has been excessively expanded as a result of correction of the shape in the conventional example.
Figure 25B:
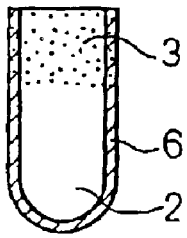
RELATED ART Fig.25B
FIG. 25B is a schematic illustration showing a state in which a non-magnetic portion has been appropriately expanded as a result of correction of the shape in the conventional example.
Figure 25C:
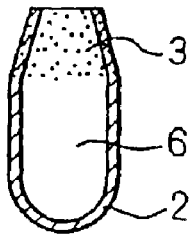
RELATED ART Fig.25C
FIG. 25C is a schematic illustration showing a state in which a non-magnetic portion has not been expanded sufficiently as a result of correction of the shape in the conventional example.

The result of measurement is shown in FIG. 21. In FIG. 21, the horizontal axis represents a depth in the thickness direction, and the vertical axis represents an intensity of the residual stress. In this case, the positive side represents a tensile stress, and the negative side represents a compressive stress. A state before shot peening is expressed by mark E41 (mark . . . ), and a state after shot peening is expressed by mark E42 (mark . . . ).

As can be seen in FIG. 21, before shot peening, a high residual tensile stress acted on the surface side, however, after shot peening, an appropriate intensity of compressive stress acted on the surface side. The above state in which the compressive stress acted on the surface side is very advantageous to enhance the stress corrosion cracking resistance property.

As a result, it can be understood that the processing of shot peening, which is a process to remove a residual stress, is an effective means for enhancing the stress corrosion cracking resistance property of a composite magnetic member.

It is possible to apply the composite magnetic member obtained in this example to the electromagnetic valve shown in Example 6. Further, it is possible to apply the composite magnetic member obtained in this example to various devices.

Example 8

Before the explanation of the example of the method of producing a steel member from which a composite magnetic steel member composed of a non-magnetic portion and a ferromagnetic portion can be continuously produced, there will be explained a conventional method of producing a yoke of a rotary electric machine, an electric motor and a sleeve of an electromagnetic valve which are examples of parts of the ferromagnetic body having the non-magnetic and the ferromagnetic portion.

For example, a yoke incorporated into a motor of an electronic clock is formed into a shape shown in FIGS. 26A to 26D. The yoke 20 is composed of a right ferromagnetic portion 212, a left ferromagnetic portion 211 and a non-magnetic portion 215 to magnetically separate (insulate) both the ferromagnetic portions 211, 212.

Figure 26A:
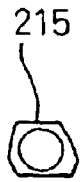
FIGS. 26A to 26D are views showing a shape of the conventional yoke and also showing a process of producing the yoke.
Figure 26B:
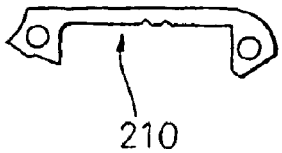
Figure 26C:
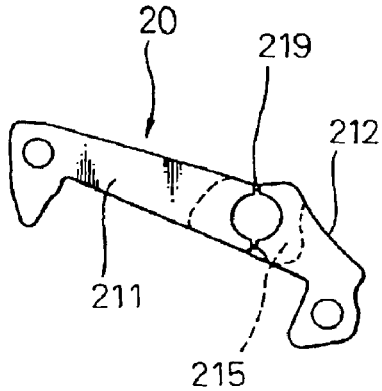
Figure 26D:
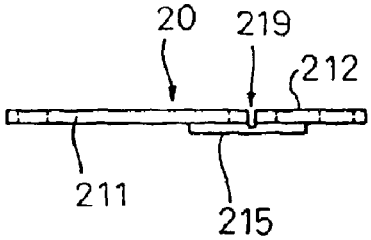

A conventional method of producing the above yoke 20 is described below. As illustrated in FIGS. 26A to 26C, there are provided a ferromagnetic member 210 and a non-magnetic member 215, which are joined to each other by means of laser beam welding. After that, a slit 219 is formed in the ferromagnetic member 210, so that the ferromagnetic member 210 is divided into the right ferromagnetic portion 212 and the left ferromagnetic portion 211. In this way, the ferromagnetic portions 211, 212 are separated from each other by the slit 219 and the non-magnetic member 215. Therefore, it is possible to form different magnetic circuits by the ferromagnetic portions 211, 212.

Figure 27A:
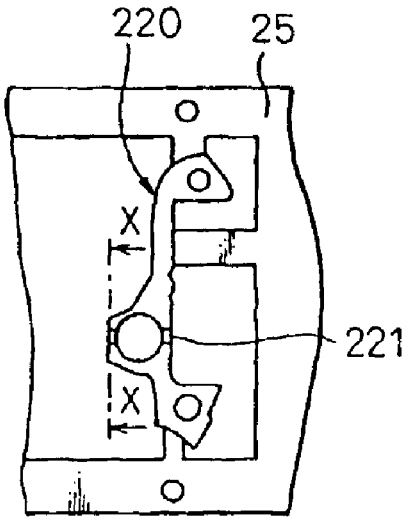
FIGS. 27A to 27D are views showing a shape of the conventional yoke and also showing another process of producing the yoke.
Figure 27B:
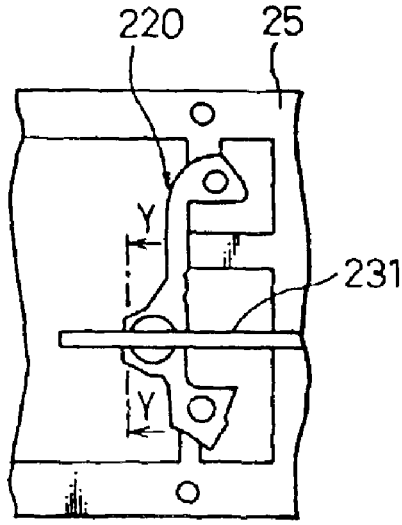
Figure 27C:
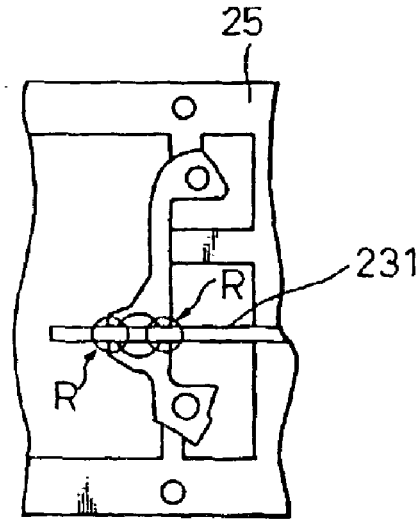
Figure 27D:
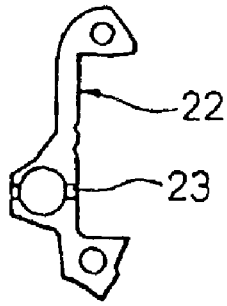

Another method of producing the same composite magnetic member as described above by means of flow production will be described below. As illustrated in FIGS. 27A to 27D, 28A and 28B, and 29A to 29C, a non-magnetic wire 231 is placed in a groove 221 of a ferromagnetic member 220 formed by press forming, and both members 220, 231 are welded to each other and punched. That is, as illustrated in FIG. 27A, first, the ferromagnetic member 220 is formed by a progressive press die, and a groove 221 is formed at a position where a non-magnetic portion 23 is formed as illustrated in FIG. 27D. Then, as illustrated in FIG. 27B, a wire 231, which is a non-magnetic body, is placed in the groove 221. Next, as illustrated in FIG. 27C, the wire 231 and the ferromagnetic member 220 are welded with each other by means of laser beam welding at the position indicated by mark . . . R. Finally, as illustrated in FIG. 27D, the member 22 is punched from the frame 25 and the wire 231.

On the other hand, Japanese Unexamined Patent Publication No. 62-25863 discloses a method of forming a ferromagnetic portion and a non-magnetic portion in such a manner that magnetic particles are mixed in non-magnetic powder or liquid, and an intensity of distribution of magnetic field to be impressed is controlled so that the distribution of magnetic particles can be made to deviate.

Japanese Unexamined Patent Publication No. 7-11397 discloses a method of producing a composite magnetic steel member composed of a ferromagnetic portion and a non-magnetic portion, the magnetic properties of which can be maintained even at an extremely low temperature of 40 degrees centigrade below freezing point.

According to the latter method, after steel has been made ferromagnetic by cold working, it is formed to a steel member. Then, only a portion of the steel member to be made non-magnetic is heated for a short period of time by means of high frequency induction heating, so that the portion can be subjected to solution heat treatment and made non-magnetic. When the crystal grain size is made to be not more than 30 $\mu$m, the point Ms at which austenite is transformed into martensite is lowered.

However, the following problems may be caused in each method described above.

Figure 28A:
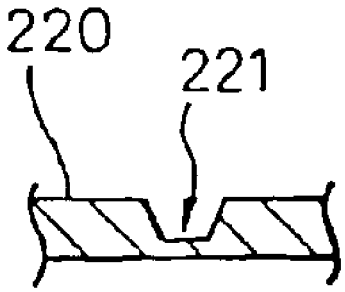
FIG. 28A is a cross-sectional view taken on line X—X in FIG. 27A.
Figure 28B:
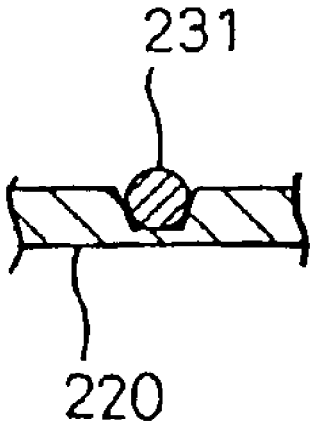
FIG. 28B is a cross-sectional view taken on line Y—Y in FIG. 27B.

According to the conventional methods illustrated in FIGS. 26A to 26D and 27A to 27D, two parts (one is a ferromagnetic part, and the other is a non-magnetic part) must be provided and joined to each other, and further the above two parts must be produced in different processes. As a result, the productivity is low, and it is difficult to reduce the production cost. According to the method illustrated in FIGS. 27A to 27D, it is easy to conduct a continuous production. Therefore, the productivity of the method illustrated in FIGS. 27A to 27D is higher than that of the method illustrated in FIGS. 26A to 26D. However, as illustrated in FIGS. 28A and 28B, there exists a thin bottom portion of the groove 221. Accordingly, the right portion and the left portion are not magnetically separated from each other. As a result, the magnetic insulation of the method illustrated in FIGS. 27A to 27D is lower than that of the method illustrated in FIGS. 26A to 26D.

On the other hand, according to the method disclosed in Japanese Unexamined Patent Publication No. 62-25863, magnetic particles are mixed in non-magnetic powder or liquid. Accordingly, since the mother material is non-magnetic, a magnetic intensity of the ferromagnetic portion is lowered.

According to the method of producing a composite magnetic member disclosed in Japanese Unexamined Patent Publication No. 7-11397, after magnetic material has been previously formed into a shape of the complete composite magnetic member, a portion to be made non-magnetic is locally heated so that the portion can be transformed into a non-magnetic portion. However, according to this method, for example, when minute parts such as yokes and others to compose an electronic clock are produced, it is difficult to form the non-magnetic portion with accuracy. The reason is that the structure of the locally heated non-magnetic portion is transformed from austenite to martensite, so that the volume is reduced. Accordingly, in the cases of producing minute parts, there is a possibility that the parts are deformed.

According to the present invention, the above problems of the prior art can be solved. The present invention is to provide a method of producing a steel member composed of a non-magnetic portion and a ferromagnetic portion, by which even a small steel member can be effectively mass-produced.

Example 9

Figure 30:
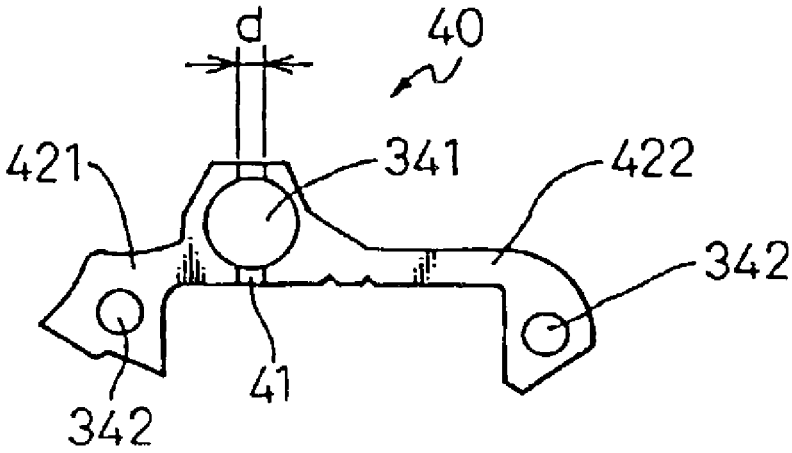
FIG. 30 is a plan view of a steel member (yoke) in Example 8.

As illustrated in FIG. 30, this example shows a method of producing a steel member (yoke incorporated into a motor of an electronic clock) composed of a non-magnetic portion 41 and ferromagnetic portions 421, 422.

Figure 29A:
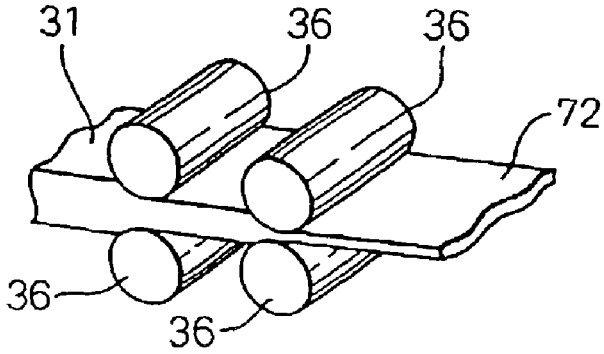
FIGS. 29A to 29C are views showing a flow of the method of production in Example 8.
Figure 29B:
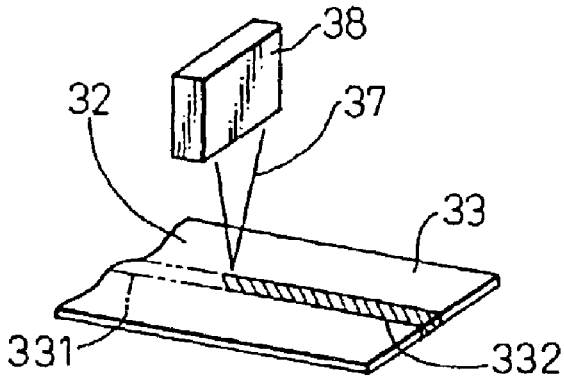
Figure 29C:
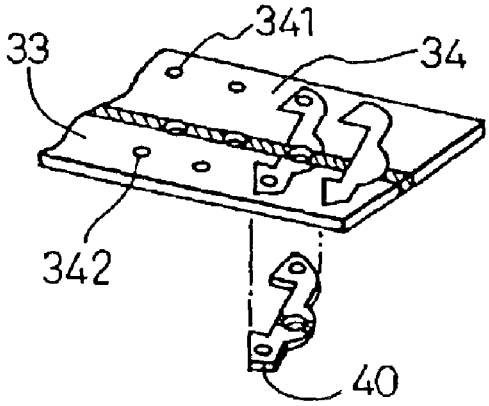

This production method includes: a first process in which a non-magnetic long body 31 of the austenite structure is subjected to cold rolling by rollers 36, so that a ferromagnetic long body 32 of the martensite structure can be continuously formed as illustrated in FIG. 29A; a second process in which a portion 331 of the long body 32 corresponding to the non-magnetic portion 41 (shown in FIG. 29) is selectively annealed, so that a new long body 33 can be formed as illustrated in FIG. 29B; and a third process in which holes 341, 342 are formed in the partially annealed long body 33, and a steel member 40 of a predetermined shape is successively punched from the thus provided long body 34 as illustrated in FIG. 29C.

In the second process illustrated in FIG. 29B, annealing is conducted by irradiating laser beams 37. Due to the foregoing, a portion irradiated by the laser beams 37 can be made to be a non-magnetic body 332.

In the third process illustrated in FIG. 29C, a yoke 40 is separated by warm-punching conducted in the temperature range from 40° C. to 600° C.

Explanations will be further made as follows.

As illustrated in FIG. 30, the steel member (yoke) 40 to be produced in this example includes a band-shaped nonmagnetic portion 41, and ferromagnetic portions 421, 422. In the boundaries of the band-shaped non-magnetic portion 41 and the ferromagnetic portions 421, 422, there is formed a rotor hole 341, and in the ferromagnetic portions 421, 422, there are formed holes 342. The size of the yoke 40 is 9.9×3.7 mm, and the band width d of the non-magnetic portion 41 is 0.5 mm.

At first, the non-magnetic long body 31 made of austenite stainless steel SUS304 is cold-rolled as illustrated in FIG. 29A. As a result of cold rolling, the structure of the long body 31 is changed to martensite by the stress induced-martensite transformation, so that a ferromagnetic elongated body 32 can be obtained.

According to the process of the prior art, the ferromagnetic stainless steel is subjected to solution heat treatment (ST treatment), so that the martensite structure is returned to the initial austenite structure, that is, the elongated body is made to be non-magnetic, and then it is subjected to processing. In this example, the solution heat treatment (ST treatment) is not conducted, but a portion of the ferromagnetic elongated body 32 is made to be non-magnetic. That is, a non-magnetic portion 332, the width of which is the same as "d" (shown in FIG. 30) of the width of the non-magnetic portion 41, is formed at a position corresponding to the non-magnetic portion 41 of the yoke 40 by the following process.

As illustrated in FIG. 29B, this processing is performed as follows. While the long body 32 is continuously moved, a region of the width "d" of the elongated body 32 is irradiated with laser beams 37 emitted from the $CO_2$ laser beam source 38. The structure of this region irradiated with the laser beams 37 is transformed from martensite to austenite, that is, only this region is made to be non-magnetic. In this way, a band-shaped non-magnetic portion 332 is continuously formed.

Next, as illustrated in FIG. 29C, warm forming and warm punching are conducted on the elongated body 32 so that a minute martensite portion can not be generated.

When punching or press-forming is conducted at a normal temperature, a minute martensite structure is generated in a portion to which stress has been applied. However, when warm forming is conducted at a temperature not lower than 40° C., it is possible to suppress the generation of the martensite structure.

In the third process, the holes 341 and 342 are successively formed in the long body 33. Then, punching is conducted in accordance with the shape of the yoke 40.

As described above, according to the production method of the present invention, it is possible to successively produce minute yokes 40, which are composite magnetic bodies, with high efficiency.

In this connection, instead of the method of laser beam machining, the method of high frequency induction heating may be applied to the annealing process to form the non-magnetic portion 332.

Figure 31:
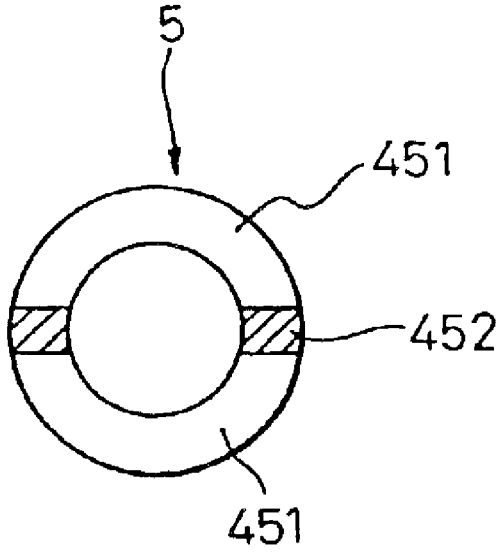
FIG. 31 is a plan view of another steel member (rotor) in Example 8.

By the same method, it is possible to produce a rotor 45 of the stepping motor, the shape of which is shown in FIG. 31. In FIG. 31, reference numeral 451 represents a ferromagnetic portion, and reference numeral 452 represents a non-magnetic portion.

Example 9

Figure 32A:
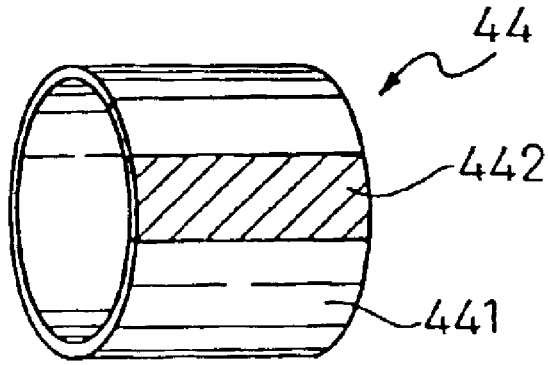
FIG. 32A is a plan view of a steel member (rotor) in Example 9.

This is an example to produce a rotor 44 of an alternating generator, the shape of which is illustrated in FIG. 32.

Figure 32B:
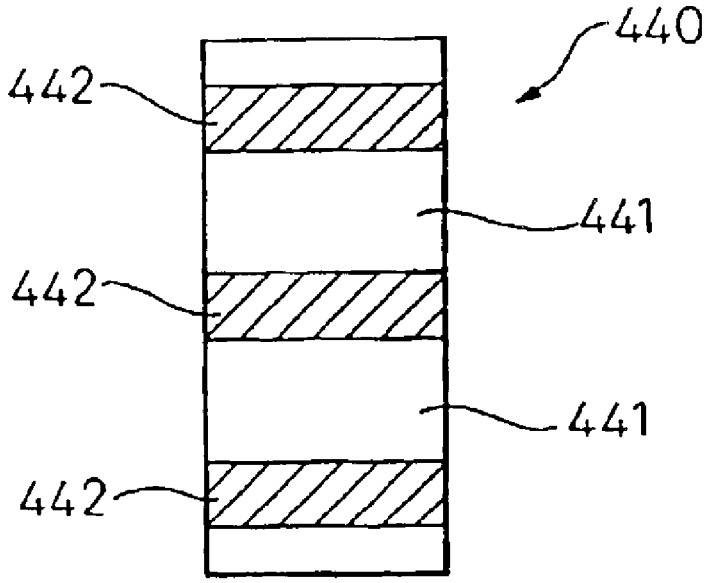
FIG. 32B is a development view of the steel member (rotor) shown in FIG. 32A.

By the same process as that illustrated in FIGS. 29A to 29C, a sheet member 440 illustrated in FIG. 32B is made. In FIGS. 33A and 33B, reference numeral 441 is a ferromagnetic portion, and reference numeral 442 is a non-magnetic portion. Successively, the sheet member 440 is bent, so that the rotor 44 illustrated in FIG. 31 can be formed.

Other points are the same as those of Example 8.

In this connection, in the above examples, a plurality of composite magnetic members are obtained. However, the present invention is not limited to the specific examples, but a single composite magnetic member may be obtained from the long body.

What is claimed is:

1. A method of stress induced-transformation of austenite stainless steel, comprising the step of conducting cold working on a material of austenite stainless steel in a temperature range not lower than the point Ms and not higher than the point Md so as to transform the austenite phase into the stress induced-martensite phase, wherein the cold working is biaxial tensing.

2. A method of producing a magnetic member, comprising the step of conducting cold working on a material of austenite stainless steel in a temperature range not lower than the point Ms and not higher than the point Md so as to transform the non-magnetic austenite phase into the ferromagnetic stress induced-martensite phase, wherein the cold working is a biaxial tensing.

3. A method of producing a composite magnetic member, comprising the steps of: conducting cold working on a material of austenite stainless steel in a temperature range not lower than the point Ms and not higher than the point Md so as to transform the non-magnetic austenite phase into the stress induced-ferromagnetic martensite phase and form a ferromagnetic portion; and conducting a stress reducing treatment on a portion of said ferromagnetic portion so as to form a non-magnetic portion of the austenite phase, to thereby form a composite magnetic member comprising the ferromagnetic portion and the non-magnetic portion contiguous to each other, wherein the cold working is a biaxial tensing.

4. A method of producing a composite magnetic member according to claim 3, wherein a uniaxial or biaxial compressing is performed after said biaxial tensing.

5. A method of producing a composite magnetic member according to claim 3, wherein said cold working is conducted in a plurality of steps.

6. A method of producing a composite magnetic member according to claim 3, wherein said cold working is conducted while the material is being forcibly cooled.

7. A method of producing a composite magnetic member made of austenite stainless steel according to claim 3, wherein said material of austenite stainless steel is comprised of C of not more than 0.6 weight %, Cr of 12 to 19 weight %, Ni of 6 to 12 weight %, Mn of not more than 2 weight %, Mo of not more than 2 weight %, Nb of not more than 1 weight %, and a residual portion composed of Fe and inevitable impurities, and wherein Hirayama's Equivalent Heq=[Ni %]+1.05 [Mn %]+0.65 [Cr %]+0.35 [Si %]+12.6 [C %] is 20 to 23%, and the nickel equivalent Nieq=[Ni %]+30 [C %]+0.5 [Mn %] is 9 to 12%, and the chromium equivalent Creq=[Cr %]+[Mo %]+1.5 [Si %]+0.5 [Nb %] is 16 to 19%.

* * * * *